US005938793A

United States Patent [19]

Reinert et al.

[11] Patent Number: 5,938,793

[45] **Date of Patent: *Aug. 17, 1999**

[54] PROCESS FOR INCREASING THE SUN PROTECTION FACTOR OF CELLULOSIC FIBRE MATERIALS

[75] Inventors: Gerhard Reinert, Allschwil; Francesco Fuso, Therwil; Rolf Hilfiker, Basel, all of Switzerland

[73] Assignee: Ciba Specialty Chemicals Corporation, Tarrytown, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/875,985

[22] PCT Filed: Jan. 31, 1996

[86] PCT No.: PCT/EP96/00399

§ 371 Date: Aug. 11, 1997

§ 102(e) Date: Aug. 11, 1997

[87] PCT Pub. No.: WO96/25549

PCT Pub. Date: Aug. 22, 1996

[30] Foreign Application Priority Data

Feb. 13, 1995 [CH] Switzerland ..... 422/95

[51] Int. Cl.[6] ..... D06P 03/66

[52] U.S. Cl. ..... 8/442; 8/490; 8/543; 8/549; 8/918; 8/566; 8/587; 8/602

[58] Field of Search ..... 8/543–9, 442, 8/490, 918, 566, 587, 602

[56] References Cited

U.S. PATENT DOCUMENTS

| | | | |
|---|---|---|---|
| 3,041,330 | 6/1962 | Coleman et al. | 260/231 |
| 3,042,669 | 7/1962 | Boyle et al. | 260/214 |
| 4,166,176 | 8/1979 | Eckstein et al. | 542/460 |
| 5,387,262 | 2/1995 | Nelson . | |
| 5,552,532 | 9/1996 | Klier et al. . | |
| 5,637,348 | 6/1997 | Thompson et al. . | |
| 5,700,295 | 12/1997 | Fuso et al. | 8/189 |

FOREIGN PATENT DOCUMENTS

| | | |
|---|---|---|
| 2384827 | 10/1978 | France . |
| 1344991 | 1/1974 | United Kingdom . |
| 2174731 | 11/1986 | United Kingdom . |
| 2248451 | 4/1992 | United Kingdom . |
| 9404515 | 3/1994 | WIPO . |

*Primary Examiner*—Margaret Einsmann
*Attorney, Agent, or Firm*—Kevin T. Mansfield; Jacob M. Levine; David R. Crichton

[57] ABSTRACT

The present invention relates to a process for increasing the sun protection factor of cellulosic fiber materials, which comprises treating the cellulosic fiber materials with at least one reactive dye and at least one reactive UV absorber.

15 Claims, No Drawings

PROCESS FOR INCREASING THE SUN PROTECTION FACTOR OF CELLULOSIC FIBRE MATERIALS

The present invention relates to a process for increasing the sun protection factor of cellulosic fibre materials, which comprises treating the cellulosic fibre materials with reactive dyes in the presence of at least one reactive UV absorber.

The skin-damaging effect of UV radiation is known. Protection from strong sunlight is usually sought by applying a sun cream, a composition that contains a UV absorber, directly to the skin. In particularly sunny regions, for example in Australia or America, however, the rate of skin damage due to UV radiation is lately increasing dramatically. Accordingly, more attention is paid in these countries to protecting the skin from solar irradiation.

It has therefore been proposed that the skin should be protected not just directly, but also to reduce the UV transmissibility of the clothing and also of other sun protection articles fabricated from cellulosic fibre materials, such as awnings or parasols. Most cellulosic fibre materials, whether dyed or undyed, are at least partially transparent to UV radiation, so that the mere wearing of clothing does not offer adequate protection to the skin from damage due to UV radiation. A remedy is possible here by incorporating UV absorbers into the fibre material.

However, hitherto the results achieved in respect of the protection from UV radiation in the area of cellulosic fibre materials, in particular textile materials, have not been satisfactory and there therefore continues to be a need for improving the sun protection factor of these materials.

It has now been found, surprisingly, that even better sun protection can be achieved if cellulosic fibre materials are treated with a combination of reactive dyes with reactive UV absorbers.

The present invention accordingly provides a process for increasing the sun protection factor of cellulosic fibre materials, which comprises treating the cellulosic fibre materials with at least one reactive dye and at least one reactive UV absorber.

In the process of the present invention, the amounts in which the reactive dyes are used in the dyebaths may vary with the desired depth of shade; in general, advantageous amounts range from 0.001 to 10% by weight, in particular from 0.001 to 5% by weight, based on the weight of the fibre material.

The amounts of reactive UV absorber used in the process of the present invention can vary between 0.001 and 5% by weight, based on the weight of the fibre material.

In a preferred embodiment of the process of the present invention, the amount of reactive UV absorber used depends on the total amount of dye used. For instance, the amount of reactive UV absorber used is from 0.5 to 5% by weight, in particular from 0.5 to 1% by weight, based on the weight of the fibre material, in the case of pale shades, from 0.05 to 0.5% by weight in the case of medium shades and from 0.001 to 0.05% by weight in the case of deep shades. Pale shades are to be understood as meaning those where the amount of dye used is from 0.001 to 0.2% by weight, based on the weight of the fibre material. Medium shades are those where the amount of dye used is from 0.2 to 2.0% by weight and deep shades are those where the amount of dye used is from 2.0 to 10% by weight, in particular from 2.0 to 5% by weight.

In a particularly preferred embodiment of the process of the present invention, the amount of reactive dye used is from 0.2 to 2% by weight, based on the weight of the fibre material, and the amount of reactive UV absorber used is from 0.05 to 0.5% by weight, based on the weight of the fibre material.

In a very particularly preferred embodiment of the process of the present invention, the amount of reactive dye used is from 0.001 to 0.2% by weight, based on the weight of the fibre material, and the amount of reactive UV absorber used is from 0.5 to 1% by weight, based on the weight of the fibre material.

The process of the present invention makes it possible to achieve an adequate sun protection factor in fibre material dyed or printed in any desired shade, an adequate sun protection factor being a sun protection factor with the value of at least 30.

Reactive dyes are to be understood as meaning those dyes which contain one or more reactive groups. This includes for example the "reactive dyes" of the Colour Index, 3rd edition (3rd revision 1987 including additions and amendments up to, for example, No. 85).

Reactive groups are to be understood as meaning fibre-reactive radicals which are capable of reacting with the hydroxyl groups of cellulose, the amino, carboxyl, hydroxyl and thiol groups of wool and silk or with the amino and possibly carboxyl groups of synthetic polyamides to form covalent chemical bonds. The reactive groups are generally bonded to the dye radical directly or via a bridge member. Suitable reactive groups are for example those which contain at least one detachable substituent attached to an aliphatic, aromatic or heterocyclic radical or in which the radicals mentioned contain a radical suitable for reaction with the fibre material, for example a triazine radical. Examples of reactive groups include radicals containing carbocyclic or heterocyclic 4-, 5- or 6-membered rings substituted by a detachable atom or group. Examples of suitable heterocyclic radicals include for example those which contain at least one detachable substituent attached to a heterocyclic radical; including those which contain at least one reactive substituent attached to a 5- or 6-membered heterocyclic ring, such as a monoazine, diazine, triazine, pyridine, pyrimidine, pyridazine, pyrazine, thiazine, oxazine or asymmetrical or symmetrical triazine ring, or to such a ring system as has one or more fused-on aromatic rings, such as a quinoline, phthalazine, cinnoline, quinazoline, quinoxaline, acridine, phenazine and phenanthridine ring system. Furthermore, the heterocyclic fibre-reactive radicals mentioned may contain, via a direct bond or via a bridge member, further fibre-reactive radicals, for example the above-recited radicals. Suitable further reactive groups include those which contain at least one activated unsaturated group, in particular an unsaturated aliphatic group, for example a vinyl, halovinyl, styryl, acryloyl or methacryloyl group, or at least one polymerizable ring system. Examples of such groups are unsaturated groups containing halogen atoms, such as halomaleic acid radicals and halopropiolic acid radicals, α or β-bromo- or chloro-acryloyl, halogenated vinylacetyl groups, halocrotonyl or halomethacryloyl groups. Also suitable are those groups which are readily converted, for example by elimination of hydrogen halide, into halogen-containing unsaturated groups, for example dichloropropionyl or dibromopropionyl. Halogen atoms are here to be understood as meaning fluorine, chlorine, bromine and iodine atoms but also pseudohalogen atoms, for example cyano. Good results are obtained by the processes of the present invention with dyes which contain an α-bromoacryloyl group. Preference among dyes which contain a polymerizable double bond is given to those which contain at least one acryloyl, methacryloyl, α-bromoacryloyl, α-chloroacryloyl, vinyl or vinylsulfonyl radical; very particularly preferably to those which contain at least one acryloyl, α-bromoacryloyl or vinylsulfonyl radical. Preference among dyes which contain a polymerizable ring system is given to those which contain at least one epoxide radical.

Examples of further detachable atoms or groups are ammonium including hydrazinium, sulfato, thiosulfato, phosphato, acetoxy, propionoxy and carboxypyridinium.

The bridge member between the dye radical and the fibre-reactive radical or the bridge member between two fibre-reactive radicals can be a wide variety of radicals as well as a direct bond. The bridge member is for example an aliphatic, aromatic or heterocyclic radical; furthermore, the bridge member may also be a combination of various such radicals. The bridge member generally contains at least one functional group, for example carbonyl or amino, in which case the amino group may be further substituted by unsubstituted or halogen-, hydroxyl-, cyano-, $C_1$–$C_4$alkoxy-, $C_1$–$C_4$alkoxycarbonyl-, carboxyl-, sulfamoyl-, sulfo- or sulfato-substituted $C_1$–$C_4$alkyl. A suitable aliphatic radical is for example an alkylene radical having 1 to 7 carbon atoms or its branched isomers. The carbon chain of the alkylene radical may be interrupted by a hetero atom, for example an oxygen atom. A suitable aromatic radical is for example a phenyl radical, which may be substituted by $C_1$–$C_4$alkyl, e.g. methyl or ethyl, $C_1$–$C_4$alkoxy, e.g. methoxy or ethoxy, halogen, e.g. fluorine, bromine or in particular chlorine, carboxyl or sulfo, and a suitable heterocyclic radical is for example a piperazine radical. Examples of such bridge members are the following radicals:

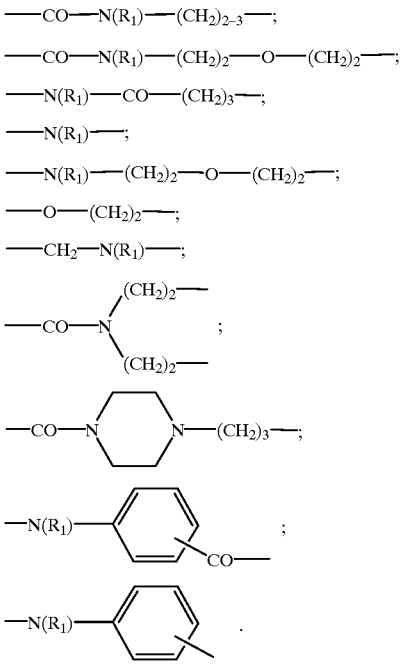

In the above-indicated formulae, $R_1$ is hydrogen or $C_1$–$C_4$alkyl which may be substituted by halogen, hydroxyl, cyano, $C_1$–$C_4$alkoxy, $C_1$–$C_4$alkoxycarbonyl, carboxyl, sulfamoyl, sulfo or sulfato.

Interesting reactive groups are 1,3,5-triazine radicals of the formula (1)

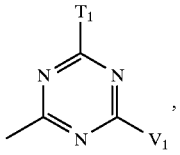

where $T_1$ is fluorine, chlorine or carboxypyridinium and the substituent $V_1$ on the triazine ring is in particular fluorine, chlorine, —$NH_2$, $C_1$–$C_6$alkylamino, N,N-di-$C_1$–$C_6$alkylamino, cyclohexylamino, N,N-dicyclohexylamino, benzylamino, phenethylamino, phenylamino, naphthylamino, N-$C_1$–$C_6$alkyl-N-cyclohexylamino, N-$C_1$–$C_6$alkyl-N-phenylamino, morpholino, piperidino, piperazino, hydrazino, semicarbazido, or furanyl-, thiophenyl-, pyrazolyl-, pyridyl-, pyrimidyl-, quinolinyl-, benzimidazolyl-, benzothiazolyl- or benzoxazolyl-substituted amino. The alkyl, cycloalkyl, aralkyl and aryl radicals mentioned and also the heterocyclic radicals may be further substituted as indicated under the formula (1).

$V_1$ in the radical of the formula (1) is particularly preferably fluorine, chlorine, phenylamino or N-$C_1$–$C_4$alkyl-N-phenylamino, in which case the phenyl rings are optionally substituted by halogen, such as fluorine, chlorine or bromine, nitro, cyano, trifluoromethyl, sulfamoyl, carbamoyl, $C_1$–$C_4$alkyl, $C_1$–$C_4$alkoxy, acylamino groups, such as acetylamino or benzoylamino, ureido, hydroxyl, carboxyl, sulfomethyl or in particular sulfo.

Interesting fibre-reactive radicals are for example those of the formula (2)

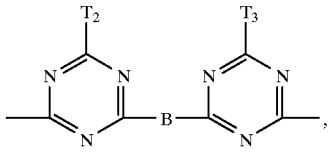

where $T_2$ and $T_3$ are independently of each other fluorine, chlorine or carboxypyridinium and B is a bridge member.

A suitable bridge member B is for example a radical of the formula

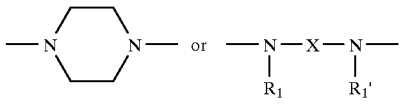

where $R_1$ and $R_1'$ are independently of each other hydrogen or unsubstituted or halogen-, hydroxyl-, cyano-, $C_1$–$C_4$alkoxy-, $C_1$–$C_4$alkoxycarbonyl-, carboxyl-, sulfamoyl-, sulfo- or sulfato-substituted $C_1$–$C_4$alkyl and X is an unsubstituted or hydroxyl-, sulfo-, sulfato-, $C_1$–$C_4$alkoxy-, carboxyl- or halogen-substituted $C_2$–$C_6$alkylene or $C_5$–$C_9$cycloalkylene radical or an unsubstituted or $C_1$–$C_4$alkyl-, $C_1$–$C_4$alkoxy-, sulfo-, halogen- or carboxyl-substituted phenylene, biphenylene or naphthalene radical.

Further interesting reactive groups are those of the formula (3)

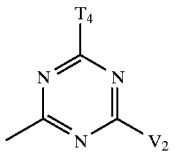

where $T_4$ is fluorine, chlorine or carboxypyridinium and $V_2$ is a radical of the formula (4)

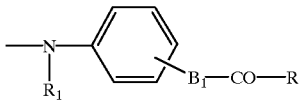

where $R_1$ is hydrogen or $C_1$–$C_4$alkyl which may be substituted by halogen, hydroxyl, cyano, $C_1$–$C_4$alkoxy, $C_1$–$C_4$alkoxycarbonyl, carboxyl, sulfamoyl, sulfo or sulfato; $B_1$ is a direct bond or a radical $-(CH_2)_n-$ or $-O-(CH_2)_n-$; n=1, 2, 3, 4, 5 or 6; and R is a radical of the formula (4a)

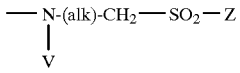

(4b)

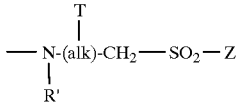

(4c)

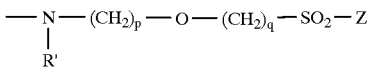

(4d)

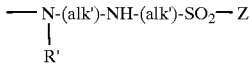

(4e)

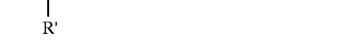

(4f)

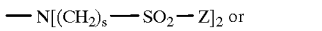

(4g)

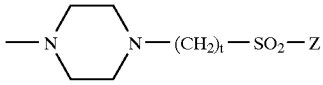

where R' is hydrogen or $C_1$–$C_6$alkyl, alk is an alkylene radical having 1 to 7 carbon atoms, T is hydrogen, halogen, hydroxyl, sulfato, carboxyl, cyano, $C_1$–$C_4$alkanoyloxy, $C_1$–$C_4$alkoxycarbonyl, carbarnoyl or a radical $—SO_2—Z$, V is hydrogen, substituted or unsubstituted $C_1$–$C_4$alkyl or a radical of the formula (4h)

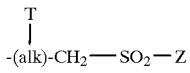

where (alk) is as defined above, each alk' is independently of the other polymethylene having 2 to 6 carbon atoms, Z is β-sulfatoethyl, β-thiosulfatoethyl, β-phosphatoethyl, β-acyloxyethyl, β-haloethyl or vinyl, p, q, r and t are each independently of the others 1, 2, 3, 4, 5 or 6 and s is 2, 3, 4, 5 or 6; and the benzene ring in the formula (4) may contain further substituents; or where $V_2$ is a radical of the formula (4a), (4b), (4c), (4d), (4e), (4f) or (4g) which is directly bonded to the triazine ring and in which R', T, alk, V, alk', Z, p, q, r, s and t are each as defined above; or where $V_2$ is a radical of the formula (4')

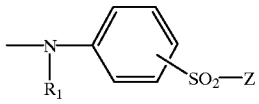

where $R_1$ and Z are each as defined above and the benzene ring may be further substituted.

Further possible substituents for the benzene rings of the compounds of the formulae (4) and (4') include halogen, such as fluorine, chlorine or bromine, nitro, cyano, trifluoromethyl, sulfamoyl, carbamoyl, $C_1$–$C_4$alkyl, $C_1$–$C_4$alkoxy, acylamino groups, such as acetylamino or benzoylamino, ureido, hydroxyl, carboxyl, sulfomethyl and sulfo.

$B_1$ contains 1 to 6, preferably 1 to 4, carbon atoms. Examples of $B_1$ are methylene, ethylene, propylene, butylene, methyleneoxy, ethyleneoxy, propyleneoxy and butyleneoxy. When $B_1$ is a radical $—O-(CH_2)_n—$, $B_1$ is attached to the benzene ring by the oxygen atom. Preferably $B_1$ is a direct bond.

A β-haloethyl Z is in particular β-chloroethyl and a β-acyloxyethyl Z is in particular β-acetoxyethyl. The alkylene radical alk is preferably methylene, ethylene, methylmethylene, propylene or butylene. An alkanoyloxy T is in particular acetyloxy, propionyloxy or butyryloxy, and an alkoxycarbonyl T is in particular methoxycarbonyl, ethoxycarbonyl or propyloxycarbonyl. An alkyl V can be methyl, ethyl, propyl, isopropyl, butyl, isobutyl, sec-butyl or tert-butyl. R' is for example methyl, ethyl, propyl, isopropyl, butyl, isobutyl, sec-butyl, tert-butyl, pentyl or hexyl, or preferably hydrogen. The polymethylene radicals alk' are preferably ethylene, propylene or butylene. The indices p, q and t are independently of one another preferably 2, 3 or 4. The indices r and s are independently of each other preferably 2.

Preferred radicals $V_2$ are those of the formula (4) where $B_1$ is a direct bond and R is a radical of the formula (4a), or where $V_2$ is a radical of the formula 4b), (4c) or (4f) bonded directly to the triazine ring, or where $V_2$ is a radical of the formula (4').

Likewise interesting are reactive groups of the formulae (4i)

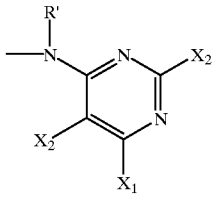

-continued (4j)

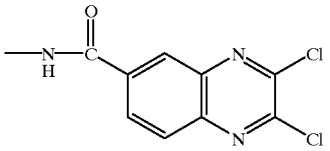

(4k)

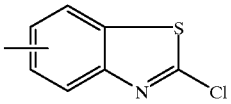

and (4l)

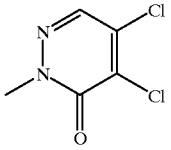

where R' is as defined above and $X_1$ and $X_2$ are each chlorine, or $X_1$ is chlorine and $X_2$ is fluorine.

Preferred aliphatic reactive groups are those of the formulae $$—SO_2Z \quad (5a),$$

$$—SO_2—NH—Z \quad (5b),$$

$$—NH—CO—(CH_2)_3—SO_2Z \quad (5c),$$

$$—CO—NH—CH_2CH_2—SO_2Z \quad (5d)$$

and $$—NH—CO—Z_1 \quad (5e),$$

where Z is as defined above, and $Z_1$ has the meaning of Z and may additionally be halomethyl or α,β-dihaloethyl.

The halogen in $Z_1$ halomethyl, β-haloethyl, and α,β-dihaloethyl groups is in particular chlorine and bromine.

Particularly preferred aliphatic reactive groups are those of the formula (5a) and also those of the formulae (5c) and (5d). Z is in particular β-sulfatoethyl or β-haloethyl in these radicals.

The reactive dyes very particularly preferably contain at least one reactive group of the formulae (1), (2), (3), (4i) to (4l) and (5a) to (5e), in which case $R_1$, $T_1$, $T_2$, $T_3$, $T_4$, $V_1$, $V_2$, B, $X_1$, $X_2$, Z and $Z_1$ are each subject to the above-indicated definitions and preferences.

The reactive dyes are derived in particular from the radical of a monoazo, polyazo, metal complex azo, anthraquinone, phthalocyanine, formazan, azomethine, dioxazine, phenazine, stilbene, triphenylmethane, xanthene, thioxanthone, nitroaryl, naphthoquinone, pyrenequinone or perylenetetracarbimide, preferably the radical of a monoazo, disazo, metal complex azo, formazan, anthraquinone, phthalocyanine or dioxazine dye. The reactive dyes may have attached to their basic structure, as well as the reactive group, the substituents customary in organic dyes as further substituents.

Examples of such further substituents for the reactive dyes are alkyl groups having 1 to 4 carbon atoms, such as methyl, ethyl, propyl, isopropyl or butyl, alkoxy groups having 1 to 4 carbon atoms, such as methoxy, ethoxy, propoxy, isopropoxy or butoxy, acylamino groups having 1 to 8 carbon atoms, in particular alkanoylamino groups and alkoxycarbonylamino groups, such as acetylamino, propionylamino, methoxycarbonylamino, ethoxycarbonylamino or benzoylamino, phenylamino, N,N-di-β-hydroxyethylamino, N,N-di-β-sulfatoethylamino, sulfobenzylamino, N,N-disulfobenzylamino, alkoxycarbonyl having 1 to 4 carbon atoms in the alkoxy radical, such as methoxycarbonyl or ethoxycarbonyl, alkylsulfonyl having 1 to 4 carbon atoms, such as methylsulfonyl or ethylsulfonyl, trifluoromethyl, nitro, cyano, halogen, such as fluorine, chlorine or bromine, carbamoyl, N-alkylcarbamoyl having 1 to 4 carbon atoms in the alkyl radical, such as N-methylcarbamoyl or N-ethylcarbamoyl, sulfamoyl, N-alkylsulfamoyl having 1 to 4 carbon atoms, such as N-methylsulfamoyl, N-ethylsulfamoyl, N-propylsulfamoyl, N-isopropylsulfamoyl or N-butylsulfamoyl, N-(β-hydroxyethyl)sulfamoyl, N,N-di-(β-hydroxyethyl) sulfamoyl, N-phenylsulfamoyl, ureido, hydroxyl, carboxyl, sulfomethyl or sulfo and also further fibre-reactive radicals. Preferably the reactive dyes contain one or more sulfonic acid groups.

Preferably the reactive dyes are derived from the following dye radicals:

a) dye radicals of a 1:1 copper complex azo dye of the benzene or naphthalene series wherein the copper atom is attached on both sides to a metallizable group each ortho to the azo bridge.

b) Particular preference is given to the mono- or disazo dye radicals of the formula $$D_1—N=N—(M—N=N)_u—K— \quad (6a),$$

$$—D_1—N=N—(M—N=N)_u—K \quad (6b)$$

or $$—D_1—N=N—(M—N=N)_u—K— \quad (6c),$$

or to a metal complex derived therefrom; $D_1$ is the radical of a diazo component of the benzene or naphthalene series, M is the radical of a middle component of the benzene or naphthalene series, K is the radical of a coupling component of the benzene, naphthalene, pyrazolone, 6-hydroxypyrid-2-one or acetoacetarylamide series, and $D_1$, M and K may carry substituents customary in azo dyes, in particular hydroxyl, amino, methyl, ethyl, methoxy or ethoxy groups, substituted or unsubstituted alkanoylamino groups having 2 to 4 carbon atoms, substituted or unsubstituted benzoylamino groups, halogen atoms or a fibre-reactive radical, in particular a radical $—SO_2—Z$, where Z is β-sulfatoethyl, β-thio-sulfatoethyl, β-phosphatoethyl, β-acyloxyethyl, β-haloethyl or vinyl; u is 0 or 1; and $D_1$, M and K together contain at least one sulfo group, preferably three or four sulfo groups.

c) Preference is likewise given to the dye radicals of a disazo dye of the formula $$—D_1—N=N—K—N=N—D_2 \quad (7a)$$

or $$—D_1—N=N—K—N=N—D_2— \quad (7b),$$

where $D_1$ and $D_2$ are independently of each other the radical of a diazo component of the benzene or naphthalene series, and K is the radical of a coupling component of the naphthalene series; and where $D_1$, $D_2$ and K may carry substituents customary in azo dyes, in particular hydroxyl, amino, methyl, ethyl, methoxy or ethoxy groups, substituted or unsubstituted alkanoylamino groups having 2 to 4 carbon atoms, substituted or unsubstituted benzoylamino groups, halogen atoms or a fibre-reactive radical, in particular a radical —$SO_2$—Z, where Z is as defined above, and $D_1$, $D_2$ and K together contain at least two sulfo groups, preferably three or four sulfo groups.

Important are d) dye radicals of a formazan dye of the formula (8a)

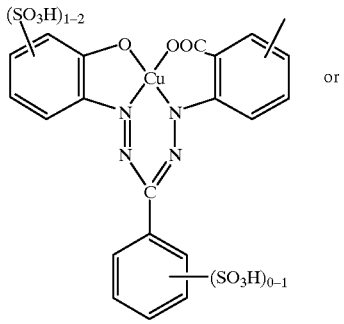

or (8b)

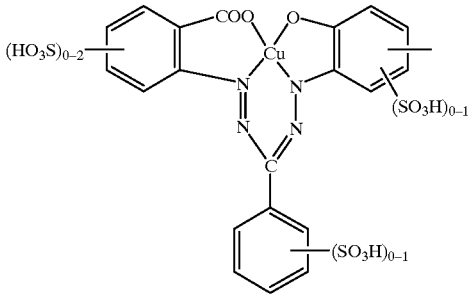

(8c)

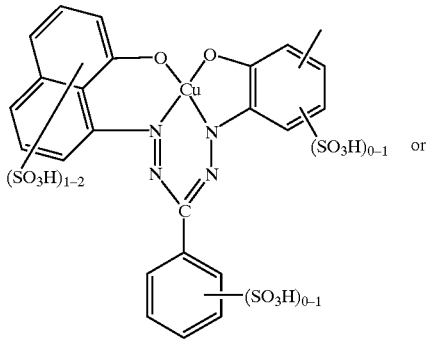

or (8d)

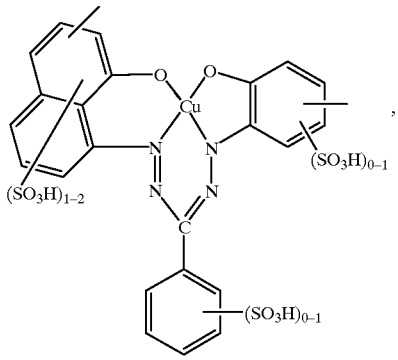

, where the benzene rings may be further substituted by alkyl having 1 to 4 carbon atoms, alkoxy having 1 to 4 carbon atoms, alkylsulfonyl having 1 to 4 carbon atoms, halogen or carboxyl.

e) dye radicals of an anthraquinone dye of the formula (9)

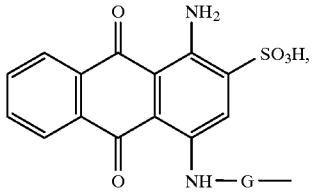

where G is a phenylene, cyclohexylene, phenylenemethylene or $C_2$–$C_6$alkylene radical; where the anthraquinone nucleus may be substituted by a further sulfo group, and phenyl G by alkyl having 1 to 4 carbon atoms, alkoxy having 1 to 4 carbon atoms, halogen, carboxyl or sulfo, and the dye preferably contains at least 2 sulfo groups.

f) dye radicals of a phthalocyanine dye of the formula (10)

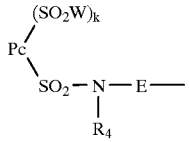

, where Pc is the radical of a copper or nickel phthalocyanine; W is —OH and/or —$NR_5R_{5'}$; $R_5$ and $R_{5''}$ are independently of each other hydrogen or alkyl having 1 to 4 carbon atoms, which may be substituted by hydroxyl or sulfo; $R_4$ is hydrogen or alkyl having 1 to 4 carbon atoms; E is a phenylene radical which may be substituted by alkyl having 1 to 4 carbon atoms, halogen, carboxyl or sulfo; or is an alkylene radical having 2 to 6 carbon atoms, preferably a sulfophenylene or ethylene radical; and k is 1, 2 or 3.

g) dye radicals of a dioxazine dye of the formula (11a)

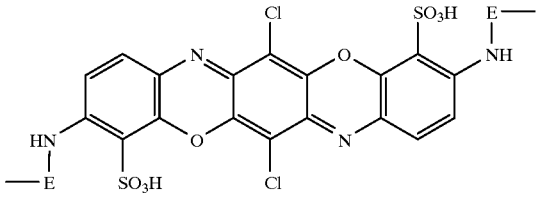

or (11b)

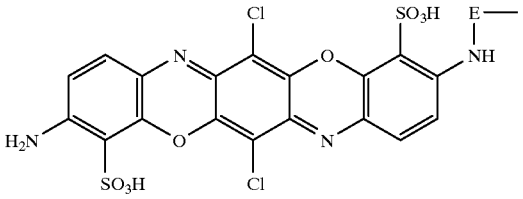

where E is a phenylene radical which may be substituted by alkyl having 1 to 4 carbon atoms, halogen, carboxyl or sulfo; or is an alkylene radical having 2 to 6 carbon atoms; and the outer benzene rings in the formulae (11a) and (11b) may be further substituted by alkyl having 1 to 4 carbon atoms, alkoxy having 1 to 4 carbon atoms, acetylamino, nitro, halogen, carboxyl, sulfo or —$SO_2$—Z, where Z is β-sulfatoethyl, β-thiosulfatoethyl, β-phosphatoethyl, β-acyloxyethyl, β-haloethyl or vinyl.

Particular preference is likewise given to the use of dyes having the radical of the formulae (12a) to (12j)

(12a)

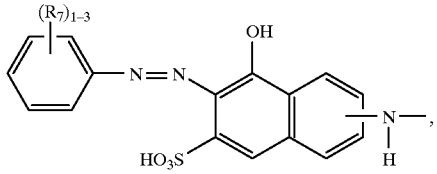

where $(R_7)_{1-3}$ represents 1 to 3 substituents selected from the group consisting of $C_1$–$C_4$alkyl, $C_1$–$C_4$alkoxy, halogen, carboxyl and sulfo;

(12b)

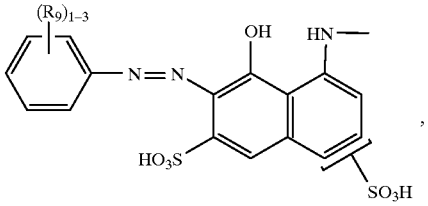

where $(R_9)_{1-3}$ represents 1 to 3 substituents selected from the group consisting of $C_1$–$C_4$alkyl, $C_1$–$C_4$alkoxy, halogen, carboxyl and sulfo;

(12c)

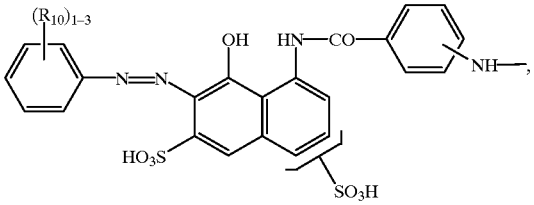

where $(R_{10})_{1-3}$ represents 1 to 3 substituents selected from the group consisting of $C_1$–$C_4$alkyl, $C_1$–$C_4$alkoxy, halogen, carboxyl and sulfo;

(12d)

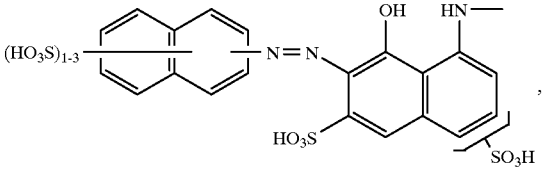

-continued (12e)

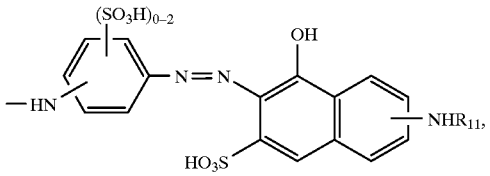

where $R_{11}$ is $C_2$–$C_4$alkanoyl or benzoyl;

(12f)

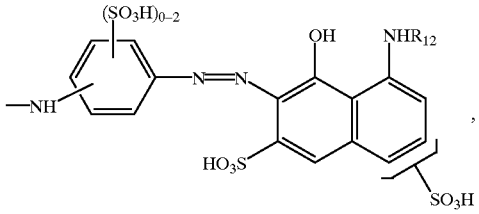

where $R_{12}$ is $C_2$–$C_4$alkanoyl or benzoyl;

(12g)

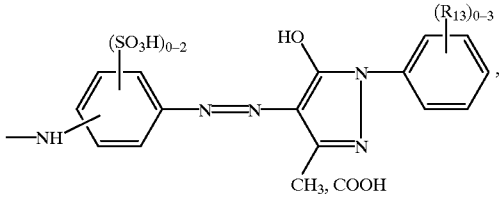

where $(R_{13})_{0-3}$ represents 0 to 3 substituents selected from the group consisting of $C_1$–$C_4$alkyl, $C_1$–$C_4$alkoxy, halogen, carboxyl and sulfo;

(12h)

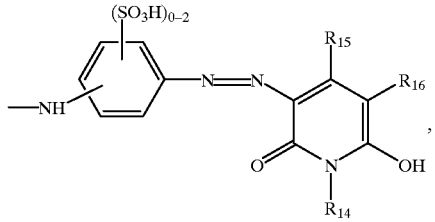

where $R_{14}$ and $R_{15}$ are independently of each other hydrogen, $C_1$–$C_4$alkyl or phenyl, and $R_{16}$ is hydrogen, cyano, carbamoyl or sulfomethyl;

(12i)

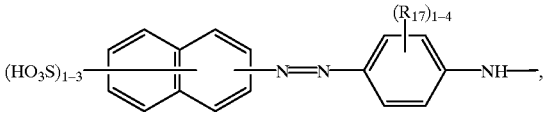

where $(R_{17})_{1-4}$ represents 1 to 4 substituents selected from the group consisting of hydrogen, halogen, nitro, cyano, trifluoromethyl, sulfamoyl, carbamoyl, $C_1$–$C_4$alkyl, $C_1$–$C_4$alkoxy, amino, acetylamino, ureido, hydroxyl, carboxyl, sulfomethyl and sulfo, independently of one another; and (12j)

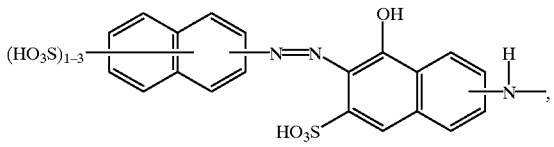

The reactive dyes preferably contain at least one water-solubilizing group, such as a sulfo or sulfato group, and are in this case present either in the form of their free acid or preferably as its salts, for example the alkali metal, alkaline earth metal or ammonium salts, or as salts of an organic amine. Examples are the sodium, potassium, lithium or ammonium salts or the salt of triethanolamine.

The reactive dyes are known or can be prepared analogously to known dyes.

Reactive UV absorbers are to be understood as meaning UV absorbers containing one or more reactive groups of the type defined above for reactive dyes. Preferred reactive UV absorbers for the process of the present invention are compounds of the formula (26)

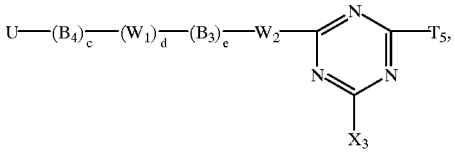

where $B_3$ and $B_4$ are each independently of the other an aliphatic bridge member, U is the radical of a UV absorber selected from the group consisting of the 2-hydroxybenzophenones, benzotriazoles, 2-hydroxyphenyl-1,3,5-triazines, oxalamides, acrylates, substituted and unsubstituted benzoic acids and esters and radicals of the formula (27)

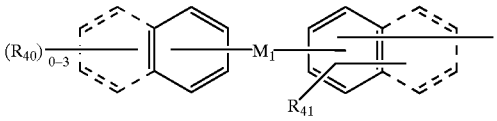

$(R_{40})_{0-3}$ denotes from 0 to 3 identical or different radicals $R_{40}$ selected from the group consisting of sulfo, $C_1$–$C_4$alkyl, $C_1$–$C_4$alkoxy, halogen, hydroxyl, carboxyl, nitro and $C_1$–$C_4$alkylcarbonylamino, $R_{41}$ is hydrogen, sulfo, $C_1$–$C_4$alkyl or $C_1$–$C_4$alkoxy, $M_1$ is a group —NR"—CO— or —NR"—$SO_2$—, R" is hydrogen or $C_1$–$C_4$alkyl, $W_2$ is a group —$NR_{42}$—, —O— or —S—, $R_{42}$ is hydrogen or substituted or unsubstituted $C_1$–$C_4$alkyl, $W_1$ is a radical —C(O)O—, —O(O)C—, —C(O)NH— or —HN(O)C—, $X_3$ is halogen, hydroxyl, sulfo, $C_1$–$C_4$alkylsulfonyl, phenylsulfonyl, substituted or unsubstituted amino, 3-carboxypyridin-1-yl or 3-carbamoylpyridin-1-yl, $T_5$ independently has one of the meanings indicated for $X_3$ or is an optionally further substituted alkoxy, aryloxy, alkylthio or arylthio radical or is a nitrogen-containing heterocyclic radical or is a reactive radical of the formula (28a)

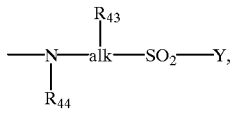

(28b)

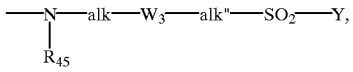

(28c)

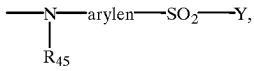

(28d)

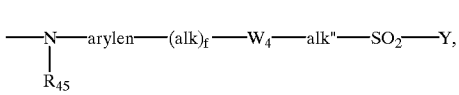

(28e)

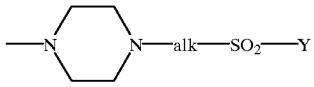

or (28f)

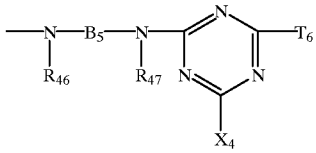

where $B_5$ is an aliphatic, cycloaliphatic, aromatic or aromatic-aliphatic bridge member or together with —$NR_{46}$— and —$NR_{47}$— is a heterocyclic ring, $R_{46}$ and $R_{47}$ are each independently of the other hydrogen or substituted or unsubstituted $C_1$–$C_4$alkyl, $X_4$ is halogen, hydroxyl, substituted or unsubstituted amino, 3-carboxypyridin-1-yl or 3-carbamoylpyridin-1-yl, $T_6$ independently has one of the meanings indicated for $X_4$ or is an optionally further substituted alkoxy, aryloxy, alkylthio or arylthio radical or is a nitrogen-containing heterocyclic radical or independently a radical U—$(B_4)_c$—$(W_1)_d$—$(B_3)_e$—$W_2$—, where U, $B_4$, $B_3$, $W_1$ and $W_2$ are each as defined above, $R_{44}$ is hydrogen, unsubstituted or hydroxyl-, sulfo-, sulfato-, carboxyl- or cyano-substituted $C_1$–$C_4$alkyl or a radical

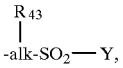

$R_{45}$ is hydrogen or $C_1$–$C_4$alkyl, $R_{43}$ is hydrogen, hydroxyl, sulfo, sulfato, carboxyl, cyano, halogen, $C_1$–$C_4$alkoxycarbonyl, $C_1$–$C_4$alkanoyloxy, carbamoyl or the group —$SO_2$—Y, alk and alk" are independently of each other $C_1$–$C_7$alkylene, arylen is an unsubstituted or sulfo-, carboxyl-, $C_1$–$C_4$alkyl-, $C_1$–$C_4$alkoxy- or halogen-substituted phenylene or naphthylene radical, Y is vinyl or a radical —$CH_2$—$CH_2$—$Z_2$ and $Z_2$ is a leaving group, $W_3$ is —O— or —$NR_{45}$—, $W_4$ is a group —$SO_2$—$NR_{44}$—, —$CONR_{44}$— or —$NR_{44}CO$—, and c, d, e and f are each independently of the others 0 or 1 with d being 0 when e is 0, with the proviso that the compounds of the formula (26) have at least one sulfo or sulfato group and at least one alkali-detachable group.

An aliphatic bridge member $B_3$ or $B_4$ is for example a straight-chain or branched $C_1$–$C_{12}$alkylene, preferably a straight-chain or branched $C_1$–$C_6$alkylene. Examples of particularly preferred alkylene radicals $B_3$ and B4 are methylene, 1,2-ethylene, 1,2-propylene, 1,3-propylene, 1,4-butylene, 2-methyl-1,5-pentylene and 1,6-hexylene, in particular methylene and 1,2-ethylene.

An aliphatic bridge member $B_5$ can be for example straight-chain or branched and optionally hydroxyl-, sulfo- or sulfato-substituted and/or —O-interrupted $C_2$–$C_{12}$alkylene. Preferably $B_5$ is straight-chain or branched $C_2$–$C_6$alkylene which may be substituted by hydroxyl, sulfo or sulfato. Examples of particularly preferred alkylene radicals $B_5$ are 1,2-ethylene, 1,2-propylene, 1,3-propylene, 2-hydroxy-1,3-propylene, 1,4-butylene, 2-methyl-1,5-pentylene and 1,6-hexylene.

A cycloaliphatic bridge member $B_5$ is for example cyclohexylene or a radical of the formula (29)

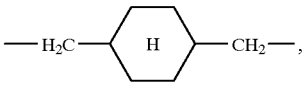

or —$NR_{46}$— and —$NR_{47}$— are combined with $B_5$ into a ring, for example a piperazine ring.

Examples of aromatic bridge members $B_5$ are unsubstituted or, for example, sulfo-, carboxyl-, $C_1$–$C_4$alkyl-, $C_1$–$C_4$alkoxy- or halogen-substituted 1,2-, 1,3- or 1,4-phenylene, unsubstituted or sulfo-substituted naphthylene or a radical of the formula (30)

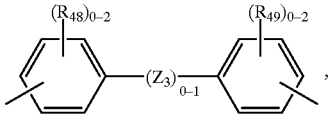

where $Z_3$ is for example —CO—, —NHCO—, —NHCONH—, —$(CH_2)_{1-4}$—, —NH—, —CH═CH—, —O—, —$SO_2$— or —N═N—; and $(R_{48})_{0-2}$ and $(R_{49})_{0-2}$ independently of each other represent 0 to 2 identical or different radicals selected from the group consisting of sulfo, methyl, methoxy and chlorine.

Preferable for use as aromatic bridge member $B_5$ are unsubstituted or sulfo-, carboxyl-, chlorine-, methyl- or methoxy-substituted 1,3- or 1,4-phenylene, naphthylene substituted by 1 or 2 sulfo groups, or a radical of the formula (30a)

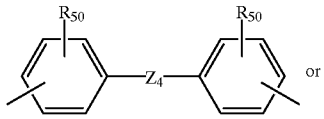

or (30b)

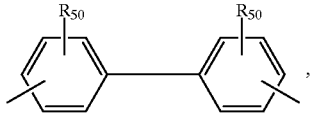

where $Z_4$ is —NHCONH—, —O—, —NH—, —CH═CH— or —$CH_2$—; and $R_{50}$ is hydrogen or sulfo.

Examples of particularly preferred aromatic bridge members $B_5$ are 1,3-phenylene, 1,4-phenylene, 4-methylphenylene-1,3,4-sulfophenylene-1,3,3-sulfophenylene-1,4,3,6-disulfophenylene-1,4,4,6-disulfophenylene-1,3,3,7-disulfonaphthylene-1,5,4,8-disulfonaphthylene-2,6,2,2'-disulfodiphenylene-4,4'phenyleneurea-2,2'-disulfonic acid or 2,2'-disulfostilbenylene-4,4' and in particular 4-sulfophenylene-1,3,3-sulfophenylene-1,4,3,6-disulfophenylene-1,4 or 4,6-disulfophenylene-1,3.

An example of aromatic-aliphatic bridge members $B_5$ is phenylene-$C_1$–$C_4$alkylene, unsubstituted or substituted in the phenylene moiety, for example by sulfo, methyl, methoxy, carboxyl or chlorine. An aromatic-aliphatic bridge member B is preferably unsubstituted phenylenemethylene or phenylenemethylene substituted by sulfo, methyl or methoxy in the phenylene moiety.

$B_5$ is preferably $C_2$–$C_6$alkylene, which may be substituted by hydroxyl, sulfo or sulfato, unsubstituted or sulfo-, carboxyl-, chlorine-, methyl- or methoxy-substituted 1,3- or 1,4-phenylene, naphthylene substituted by 1 or 2 sulfo groups, or a radical of the formula (30a)

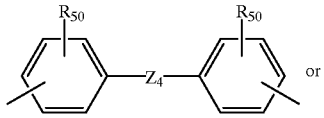

or (30b)

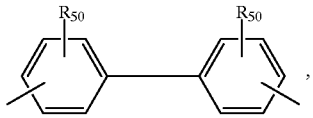

where $Z_4$ is —NHCONH—, —O—, —NH—, —CH═CH— or —$CH_2$—; and $R_{50}$ is hydrogen or sulfo.

Particularly preferably $B_5$ is 4-sulfophenylene-1,3,3-sulfophenylene-1,4, 3,6-disulfophenylene- 1,4 or 4,6-disulfophenylene- 1,3.

$R_{46}$ and $R_{47}$ are each independently of the other for example hydrogen or unsubstituted or, for example, halogen-, hydroxyl-, cyano-, $C_1$–$C_4$alkoxy-, $C_1$–$C_4$alkoxycarbonyl-, carboxyl-, sulfamoyl-, sulfo- or sulfato-substituted $C_1$–$C_4$alkyl. Preferably $R_{46}$ and $R_{47}$ are each independently of the other hydrogen or $C_1$–$C_4$alkyl, particularly preferably hydrogen, methyl or ethyl.

c and d are each preferably 0.

$R_{42}$ is for example hydrogen or unsubstituted or, for example, halogen-, hydroxyl-, cyano-, $C_1$–$C_4$alkoxy-, $C_1$–$C_4$alkoxycarbonyl-, carboxyl-, sulfamoyl-, sulfo- or sulfato-substituted $C_1$–$C_4$alkyl. Preferably $R_{42}$ is hydrogen or $C_1$–$C_4$alkyl, particularly preferably hydrogen, methyl or ethyl.

A 2-hydroxyphenyl-1,3,5-triazine radical U has for example the formula (31)

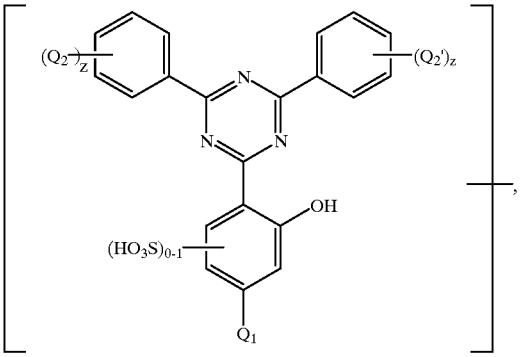

where z is an integer from 1 to 3 and $Q_1$, $Q_2$ and Q2' are each independently of the others hydrogen, hydroxyl, alkyl having 1 to 12 carbon atoms, alkoxy having 1 to 18 carbon atoms or unsubstituted or hydroxyl-substituted $C_1$–$C_4$alkoxy-$C_1$–$C_4$alkoxy.

Examples of suitable 2-hydroxyphenyl- 1,3,5-triazine radicals U are the radical of 2,4,6-tris(2-hydroxy-4-octyloxyphenyl)- 1,3,5-triazine, 2-(2-hydroxy-4-octyloxyphenyl)-4,6-bis(2,4-dimethylphenyl)-1,3,5-triazine, 2-(2,4-dihydroxyphenyl)-4,6-bis(2,4-dimethylphenyl)- 1,3,5-triazine, 2,4-bis(2-hydroxy-4-propyloxyphenyl)-6-(2,4-dimethylphenyl)-1,3,5-triazine, 2-(2-hydroxy-4-octyloxyphenyl)-4,6-bis(4-methylphenyl)-1,3,5-triazine, 2-(2-hydroxy-4-dodecyloxyphenyl)-4,6-bis(2,4-dimethylphenyl)- 1,3,5-triazine, 2-[2-hydroxy-4-(2-hydroxy-3-butyloxypropyloxy)phenyl]-4,6-bis(2,4-dimethylphenyl)- 1,3,5-triazine, 2-(2-hydroxy-4-methoxy-6-sulfophenyl)-4,6-bis(phenyl)-1,3,5-triazine or 2-[2-hydroxy-4-(2-hydroxy-3-octyloxypropyloxy)phenyl]-4,6-bis(2,4-dimethylphenyl)-1,3,5-triazine.

The benzotriazole radical U has for example the formula (32)

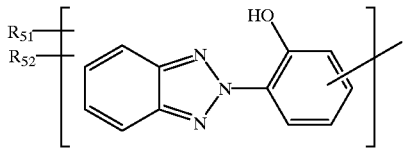

where $R_{51}$, and $R_{52}$ are independently of each other hydrogen; $C_1$–$C_4$alkyl; $C_1$–$C_4$alkoxy; halogen; hydroxyl; nitro; sulfo or carboxyl.

A 2-hydroxybenzophenone radical U has for example the formula (33)

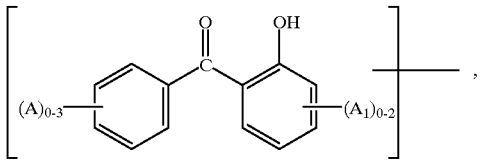

where $(A)_{0-3}$ represents 0 to 3 identical or different radicals selected from the group consisting of halogen, hydroxyl, sulfo, $C_1$–$C_{12}$alkoxy having 1 to 12 carbon atoms or phenyl-$C_1$–-$C_4$alkoxy and $(A_1)_{0-2}$ represents 0 to 2 identical or different radicals selected from the group consisting of halogen, hydroxyl, sulfo, $C_1$–$C_{12}$alkoxy having 1 to 12 carbon atoms or phenyl-$C_1$–$C_4$alkoxy.

Examples of suitable 2-hydroxybenzophenone radicals U are the radical of 2,4-dihydroxy-, 2-hydroxy-4-methoxy-, 2-hydroxy-4-octoxy-, 2-hydroxy-4-decyloxy-, 2-hydroxy-4-dodecyloxy-, 2-hydroxy-4-methoxy-5-sulfo-, 2-hydroxy-4-benzyloxy-, 4,2',4'-trihydroxy- or 2'-hydroxy-4,4'-dimethoxy-benzophenone. An oxalanilide radical U has for the example the formula (34)

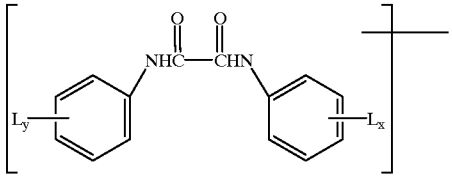

where x and y are each independently of the other an integer from 0 to 3 subject to the proviso of the sum of $(x+y) \geqq 1$, and each substituent L is independently of the others sulfo; alkyl, alkoxy or alkylthio each with 1 to 22 carbon atoms and unsubstituted or substituted alkyl moiety by sulfo; or phenoxy or phenylthio unsubstituted or substituted on the phenyl ring by sulfo.

Examples of suitable oxalanilide radicals U are the radical of 4,4'-dioctyloxyoxanilide, 2,2'-diethoxyoxanilide, 2,2'-dioctyloxy-5,5'-di-tert-butyl-oxanilide, 2,2'-di-dodecyloxy-5,5'di-tert-butyl-oxanilide, 2-ethoxy-2'-ethyloxanilide, 2-methoxy-5-sulfooxanilide, 2-ethoxy-5-sulfooxanilide, 2,5-dimethoxyoxanilide, 2-ethoxy-5-tert-butyl-2'-ethyloxanilide alone or mixed with the radical of 2-ethoxy-2'-ethyl-5,4'-di-tert-butyl-oxanilide, or mixtures of the radicals of o- and p-methoxy- and also of o- and p-ethoxy-disubstituted oxanilides.

Suitable acrylate radicals U are $C_1$–$C_{10}$alkyl acrylates which are unsubstituted or substituted by cyano or carbo-$C_1$–$C_4$alkoxy in the α-position, carry a phenyl, $C_1$–$C_4$alkoxyphenyl or indolinyl radical in one β-position and are unsubstituted or substituted by phenyl, $C_1$–$C_4$alkoxyphenyl or $C_1$–$C_4$alkyl in the other β-position.

Examples of acrylate radicals U are the radical of ethyl or isooctyl α-cyano-β,β-di-phenylacrylate, methyl α-carbomethoxycinnamate, methyl or butyl α-cyano-β-methyl-p-methoxycinnamate, methyl α-carbomethoxy-p-methoxycinnamate or N-(β-carbo-methoxy-β-cyanovinyl)-2-methylindoline.

A substituted or unsubstituted benzoic acid or ester radical U is for example an unsubstituted or hydroxyl- or $C_1$–$C_4$alkyl-substituted benzoic acid radical or its phenyl, $C_1$–$C_8$alkylphenyl or $C_1$–$C_{18}$alkyl ester. Examples are the radical of benzoic acid, 4-tert-butylphenyl salicylate, phenyl salicylate, octylphenyl salicylate, dibenzoylresorcinol, bis (4-tert-butylbenzoyl)resorcinol, benzoylresorcinol, 2,4-di-tert-butylphenyl 3,5-di-tert-butyl-4-hydroxybenzoate, hexadecyl 3,5-di-tert-butyl-4-hydroxybenzoate, octadecyl 3,5-di-tert-butyl-4-hydroxybenzoate or 2-methyl-4,6-di-tert-butylphenyl 3,5-di-tert-butyl-4-hydroxybenzoate. p When U is a radical of the above-indicated formula (27), $(R_{40})_{0-3}$ preferably denotes 0 to 3 identical or different radicals $R_{40}$ selected from the group consisting of sulfo, methyl, methoxy, hydroxyl and carboxyl, $R_{41}$ is preferably hydrogen, and $M_1$ is preferably a group —NH—CO— or —NH—$SO_2$+. U is in this case preferably a radical of the formula (27a)

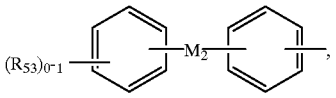

where $(R_{53})$0-1 denotes 0 or 1 radical $R_{53}$ selected from the group consisting of sulfo, methyl, methoxy, hydroxyl and carboxyl and $M_2$ is a group —NH—CO— or —NH—$SO_2$+.

Particularly preferably U is the radical of an oxalic diarylamide of the formula (35)

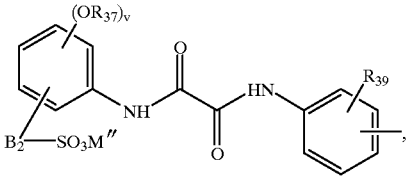

where $R_{37}$ is hydrogen, unsubstituted or hydroxyl- or alkoxy-substituted $C_1$–$C_5$alkyl or unsubstituted or $C_1$–$C_5$alkyl-substituted benzyl;

$R_{39}$ is hydrogen; halogen; $C_1$–$C_{12}$alkyl; phenyl-$C_1$–$C_5$alkyl or $C_1$–$C_5$alkoxy;

$B_2$ is a direct bond or a bivalent radical of the formula —O—$L_1$—, where $L_1$ is unsubstituted or hydroxyl-substituted $C_1$–$C_6$alkylene;

M" is hydrogen or an alkali metal and v is2;1 or 0.

A $C_1$–$C_5$alkyl $R_{37}$ is for example methyl, ethyl, n-propyl, isopropyl, n-butyl, sec-butyl, tert-butyl, amyl or isoamyl;

A halogen $R_{39}$ is for example fluorine, bromine or chlorine. Chlorine is preferred. A $C_1$–$C_{12}$alkyl $R_{39}$ can be branched or unbranched radicals, for example, methyl, ethyl, n-propyl, isopropyl, n-butyl, sec-butyl, tert-butyl, amyl, isoamyl, pentyl, neopentyl, tert-pentyl, hexyl, isohexyl, heptyl, octyl, isooctyl, nonyl, decyl, undecyl or dodecyl. A phenyl-$C_1$–$C_5$alkyl $R_{39}$ is for example phenethyl, phenylpropyl, phenylbutyl or preferably benzyl.

A $C_1$–$C_5$alkoxy $R_{39}$ is for example methoxy, ethoxy, isopropoxy, isobutoxy, tert-butoxy or tert-amyloxy.

A $C_1$–$C_6$alkylene $L_1$ is a bivalent saturated hydrocarbon radical, for example methylene, ethylene, propylene, trimethylene, tetramethylene, ethylethylene, pentamethylene or hexamethylene.

An alkali metal M" is for example lithium, sodium or potassium. Sodium is preferred.

Particularly suitable for use as a radical of the oxalic diarylamide of the formula (35) is a compound in which L is trimethylene or

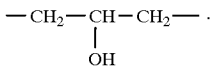

A further preferred oxalic diarylamide radical conforms to the above-indicated formula (35) where $R_{39}$ is hydrogen, $C_1$–$C_{12}$alkyl or $C_1$–$C_5$alkoxy.

Of primary interest as oxalic diarylamide radical is a compound of the above-indicated formula (35) where $R_{37}$ is $C_1$–$C_3$alkyl;

$R_{39}$ is hydrogen, $C_1$–$C_3$alkyl or $C_1$–$C_3$alkoxy;

$B_2$ is a direct bond or the radical —[O—$(CH_2)_3]_m$; and m is 0 or 1.

Very particular preference for use as oxalic diarylamide radical is given to a compound of the formula (35) where v is 0 or 1;

$R_{37}$ is methyl or ethyl;

$R_{39}$ is hydrogen or $C_1$–$C_3$alkoxy; and $B_2$ is a direct bond.

The reactive UV absorbers of the formula (26) are known or can be prepared for example by reacting a compound of the formula $$U—(B_4)_c—(W_1)_d—(B_3)_e—W_2—H \quad (36),$$

a compound of the formula (37)

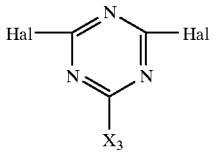

and a compound of the formula $$T_5^*—H \quad (38)$$

where U, $B_3$, $B_4$, $W_1$, $W_2$, $X_3$, c, d and e are each as defined above, Hal is halogen, preferably fluorine or chlorine, and $T_5$* has the meanings indicated above for $T_5$ other than halogen, with one another, the order of the elementary reactions being freely choosable having regard to the starting compounds to be reacted with one another.

The application of the reactive UV absorbers can take place before, during or after the application of the reactive dyes (dyeing), by an exhaust or continuous process. The application during dyeing is preferred. Particular preference is given to applying the reactive UV absorbers together with the reactive dyes.

In the exhaust process, the liquor ratio can be chosen within a wide range, for example from 3:1 to 200:1, preferably from 10:1 to 40:1. It is advantageous to operate at a temperature of 20 to 120° C., preferably 40 to 110° C., advantageously in the presence of acid-binding additions, for example sodium hydroxide, sodium carbonate, sodium bicarbonate, sodium formate, potassium carbonate, sodium silicate, sodium trichloroacetate or sodium triphosphate, in the presence or absence of neutral salts, for example sodium sulfate or sodium chloride.

In the continuous process, the liquor add-on is advantageously 40–700, preferably 40–500, % by weight. The fibre material is then subjected to a heat treatment process to fix the applied dyes and the stabilizers. This fixing can also be effected by the cold batching method.

The heat treatment preferably takes the form of a steaming process in a steamer with ordinary or superheated steam at a temperature of 98 to 105° C. for, for example, 1–7, preferably 1–5, minutes. The fixing of the dyes by the cold batching process can be effected by storing the impregnated and preferably rolled-up material at room temperature (15 to 30° C.) for 3 to 24 hours, for example, the cold batching time being known to depend on the dye.

On completion of the dye process and fixation, the produced dyeings are conventionally rinsed, soaped, for example for 20 minutes at 90° C. with a solution containing 1 g/l of a nonionic surfactant and 1 g/l of calcined sodium carbonate, and dried.

Cellulosic fibre materials are to be understood as meaning for example the natural cellulose fibre, such as cotton, linen and hemp, and also cellulose pulp and regenerated cellulose. The process of the present invention is also suitable for treating hydroxyl-containing fibres present in blend fabrics, for example blends of cotton with polyester fibres or polyamide fibres. Preference is given to fibre materials having a density between 30 and 200 g/m$^2$. Cotton is the preferred cellulosic fibre material. The fibres mentioned can be present in various forms, for example as staple or yarns or as wovens or knits.

The treatment or dyeing bath may optionally contain other customary auxiliaries, for example levelling, wetting, deaerating and antifoaming agents or penetration accelerants.

The cellulose fibre materials dyed by the process of the present invention are notable for a very high sun protection factor. The sun protection factor is defined as the ratio of the harmful dose of UV energy on protected skin to the harmful dose of UV energy on unprotected skin. Accordingly, a sun protection factor is also a measure of the UV transmissivity of untreated and reactive-dyed fibre materials untreated and treated with the reactive UV absorbers used in this invention.

The sun protection factor can be determined for example by the method described by B. L. Diffey and J. Robson in J. Soc. Cosmet. Chem. 40, 127–133 (May/June 1989).

The examples which follow illustrate the invention. The temperatures are indicated in degrees Celsius. Parts and percentages are by weight, unless otherwise stated. Parts by weight relate to parts by volume as the kilogram to the litre.

EXAMPLE 1

Four specimens each of 10 g of a bleached cotton tricot having a weight of 165 g/m$^2$ and a thickness of 0.52 mm are treated in an ®AHIBA dyeing machine at a liquor ratio of 25:1 in four different liquors.

Liquor 1 contains 250 g of water;

Liquor 2 contains 0.075 g of a UV absorber of the formula (100)

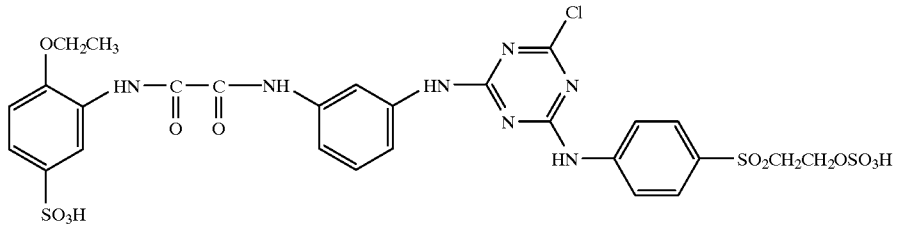

and 249.925g of water.

Liquor 3 contains 0.015 g of a red dye of the formula (200)

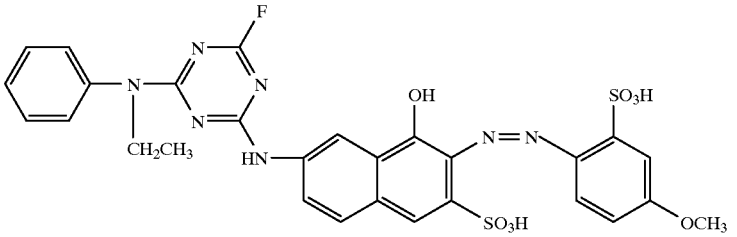

and 249.985 g of water.

Liquor 4 contains 0.075 g of the UV absorber of the formula (100), 0.015 g of the red dye of the formula (200) and 249.910 g of water.

Liquors 1 to 4 are heated to 50° C. and one substrate specimen is treated at that temperature in each liquor. Thereafter each liquor is admixed after 10, 20 and 30 minutes with 6 g of sodium chloride each time. Subsequently the liquors are heated to 60° C. over 10 minutes. After 50 minutes each liquor is admixed with 1 g of calcined sodium carbonate and after 60 minutes with 0.125 ml each of aqueous 30% NaOH solution. The liquors are then held for a further 30 minutes at 60° C. Thereafter the substrate specimens are removed from the liquors, rinsed with warm water and treated for 20 minutes at 85° C. with a solution containing 1 g/l of a commercial nonionic detergent and 0.5 g/l of calcined sodium carbonate. Thereafter the specimens are rinsed with warm water, centrifuged and dried at 110° C. The determined sun protection factors of the four specimens are reproduced in Table 1:

TABLE 1

| Specimen treated with liquor No. | Sun protection factor according to CIE D 65 | Sun protection factor according to CIE Southern Europe |
|---|---|---|
| 1 | 5 | 5 |
| 2 | 30 | 27 |
| 3 | 18 | 21 |
| 4 | 34 | 33 |

EXAMPLE 2

Example 1 is repeated, except that in liquors 3 and 4 the 0.015 g of the red dye of the formula (200) is replaced by 0.02 g of a dye of the formula (201)

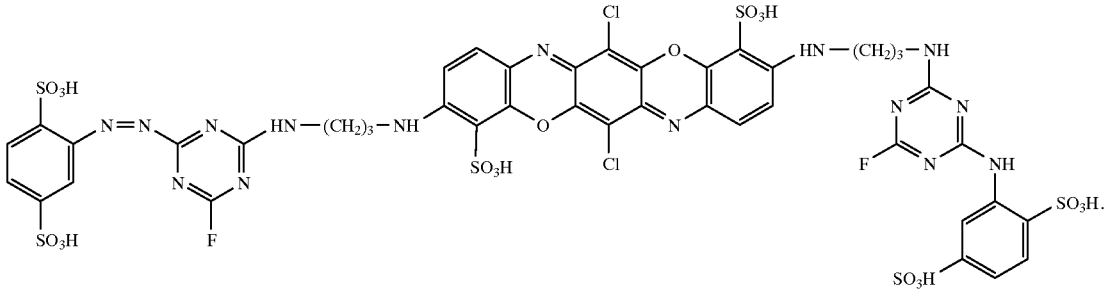

The determined sun protection factors of the four specimens are reproduced in Table 2:

TABLE 2

| Specimen treated with liquor No. | Sun protection factor according to CIE D 65 | Sun protection factor according to CIE Southern Europe |
|---|---|---|
| 1 | 5 | 5 |
| 2 | 30 | 27 |
| 3 | 10 | 12 |
| 4 | 41 | 58 |

EXAMPLE 3

Four specimens each of 10 g of a bleached cotton tricot having a weight of 165 g/m$^2$ and a thickness of 0.52 mm are each padded to a wet pick-up of 105% with four liquors of the following composition:

Liquor 1a contains 10 g/l of calcined sodium carbonate and 5 ml/l of aqueous 30% NaOH solution.

Liquor 2a contains 10 g/l of calcined sodium carbonate, 5 ml/l of aqueous 30% NaOH solution and 10 g/l of the UV absorber of the formula (100).

Liquor 3a contains 10 g/l of calcined sodium carbonate, 5 ml/l of aqueous 30% NaOH solution and 2 g/l of the dye of the formula (200).

Liquor 4a contains 10 g/l of calcined sodium carbonate, 5 ml/l of aqueous 30% NaOH solution, 10 g/l of the UV absorber of the formula (100) and 2 g/l of the dye of the formula (200).

After padding, the four specimens are rolled up on glass rods, sealed in a polyethylene bag and stored at 30° C. for 16 hours. Thereafter the specimens are rinsed with warm water and treated for 20 minutes at 85° C. with a solution containing 1 g/l of a commercial nonionic detergent and 0.5 g/l of calcined sodium carbonate, rinsed with warm water, centrifuged and dried at 110° C.

the determined sun protection factors of the four specimens are reproduced in Table 3:

TABLE 3

| Specimen treated with liquor No. | Sun protection factor according to CIE D 65 | Sun protection factor according to CIE Southern Europe |
|---|---|---|
| 1a | 4 | 4 |
| 2a | 26 | 38 |
| 3a | 14 | 17 |
| 4a | 30 | 39 |

EXAMPLE 4

Four specimens each of 10 g of a bleached cotton tricot having a weight of 185 g/m$^2$ and a thickness of 0.85 mm are treated in an ®AHIBA dyeing machine at a liquor ratio of 25:1 in four different liquors.

Liquor 1b contains 250 g of water

Liquor 2b contains 0.05 g of a UV absorber of the formula (101)

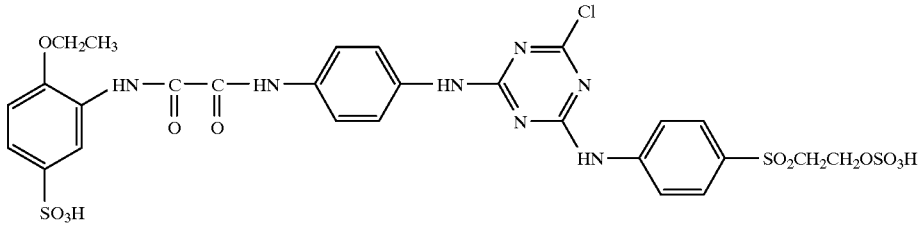

and 249.95 g of water.

Liquor 3b contains 0.012 g of a yellow dye of the formula (202)

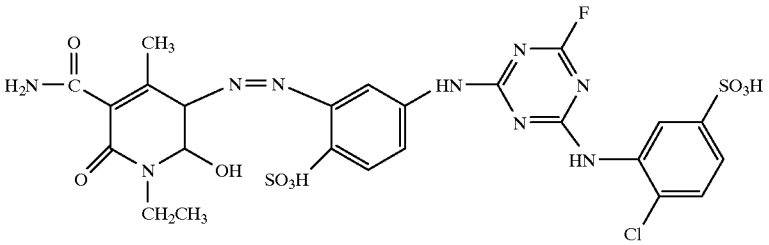

and 249.988 g of water.

Liquor 4b contains 0.05 g of the UV absorber of the formula (101), 0.012 g of the yellow dye of the formula (202) and 249.938 g of water.

Liquors 1 to 4 are heated to 50° C. and one substrate specimen is treated at that temperature in each liquor. Thereafter each liquor is admixed after 10, 20 and 30 minutes with 6 g of sodium chloride each time. Subsequently the liquors are heated to 60° C. over 10 minutes. After 50 minutes each liquor is admixed with 1 g of calcined sodium carbonate and after 60 minutes with 0.125 ml each of aqueous 30% NaOH solution. The liquors are then held for a further 30 minutes at 60° C. Thereafter the substrate specimens are removed from the liquors, rinsed with warm water and treated for 20 minutes at 85° C. with a solution containing 1 g/l of a commercial nonionic detergent and 0.5 g/l of calcined sodium carbonate. Thereafter the specimens are rinsed with warm water, centrifuged and dried at 110° C. The determined sun protection factors of the four specimens are reproduced in Table 4:

TABLE 4

| Specimen treated with liquor No. | Sun protection factor according to CIE D 65 | Sun protection factor according to CIE Southern Europe |
|---|---|---|
| 1b | 8 | 8 |
| 2b | 53 | 76 |
| 3b | 16 | 19 |
| 4b | 129 | 161 |

EXAMPLE 5

Six specimens each of 10 g of a bleached cotton tricot having a weight of 185 g/m$^2$ and a thickness of 0.85 mm are treated in an ®AHIBA dyeing machine at a liquor ratio of 25:1 in six different liquors.

Liquor 1c contains 250 g of water;

Liquor 2c contains 0.05 g of the UV absorber of the formula (101) and 249.95 g of water.

Liquor 3c contains 0.015 g of the red dye of the formula (200) and 249.985 g of water.

Liquor 4c contains 0.02 g of the dye of the formula (201) and 249.980 g of water.

Liquor 5c contains 0.05 g of the UV absorber of the formula (101), 0.015 g of the red dye of the formula (200) and 249.935 g of water.

Liquor 6c contains 0.05 g of the UV absorber of the formula (101), 0.02 g of the dye of the formula (201) and 249.930 g of water.

Liquors 1 to 6 are heated to 50° C. and one substrate specimen is treated at that temperature in each liquor. Thereafter each liquor is admixed after 10, 20 and 30 minutes with 6 g of sodium chloride each time. Subsequently the liquors are heated to 60° C. over 10 minutes. After 50 minutes each liquor is admixed with 1 g of calcined sodium carbonate and after 60 minutes with 0.125 ml each of aqueous 30% NaOH solution. The liquors are then held for a further 30 minutes at 60° C. Thereafter the substrate specimens are removed from the liquors, rinsed with warm water and treated for 20 minutes at 85° C. with a solution containing 1 g/l of a commercial nonionic detergent and 0.5 g/l of calcined sodium carbonate. Thereafter the specimens are rinsed with warm water, centrifuged and dried at 110° C. The determined sun protection factors of the six specimens are reproduced in Table 5:

TABLE 5

| Specimen treated with liquor No. | Sun protection factor according to CIE D 65 | Sun protection factor according to CIE Southern Europe |
|---|---|---|
| 1c | 8 | 8 |
| 2c | 53 | 76 |
| 3c | 32 | 39 |
| 4c | 17 | 20 |

TABLE 5-continued

| Specimen treated with liquor No. | Sun protection factor according to CIE D 65 | Sun protection factor according to CIE Southern Europe |
|---|---|---|
| 5c | 156 | 188 |
| 6c | 127 | 163 |

EXAMPLE 6

Example 1 is repeated, except that in liquors 2 and 4 the 0.075 g of the UV absorber of the formula (100) is replaced by an equivalent amount of the UV absorbers of the formula (102)

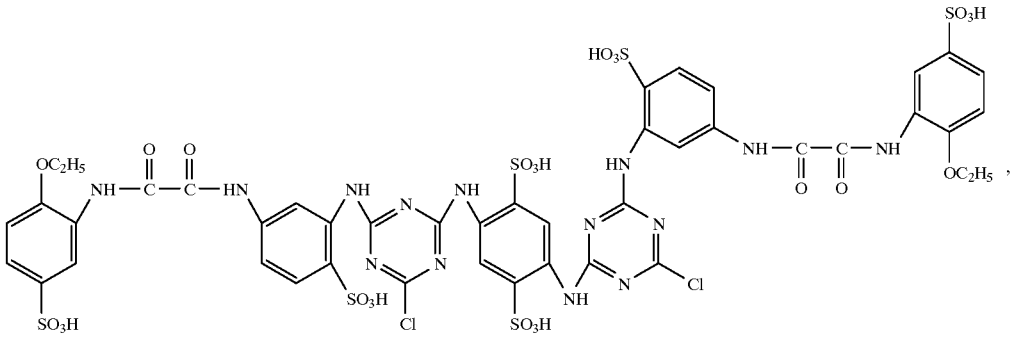

(103)

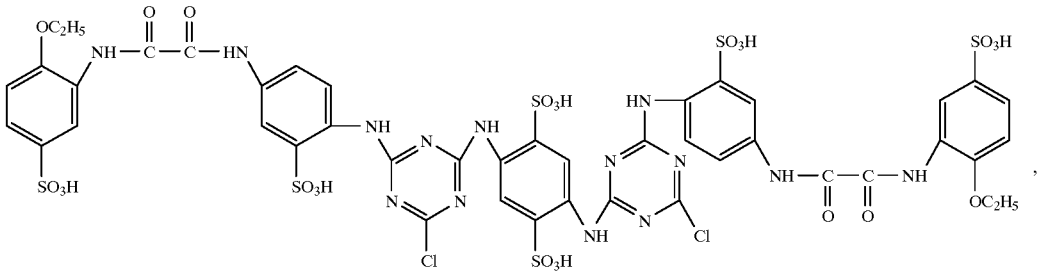

(104)

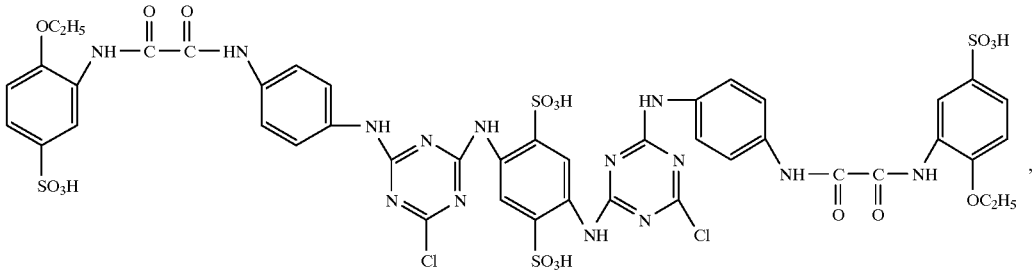

-continued
(105)
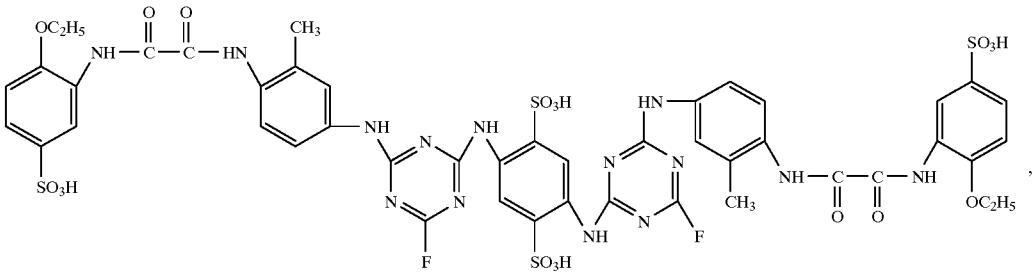
(106)
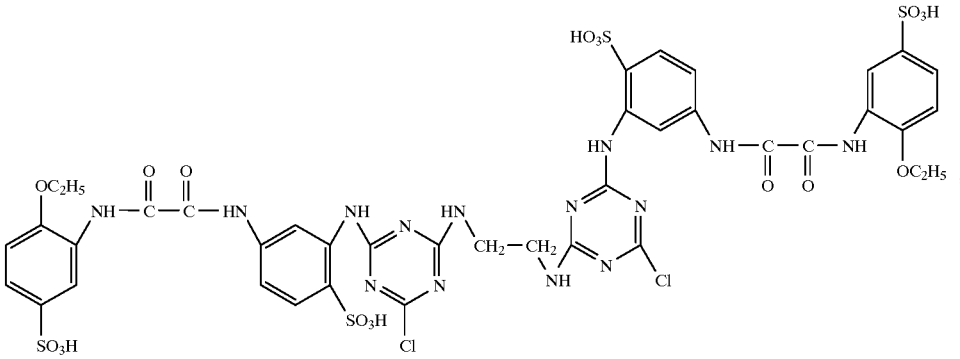
(107)
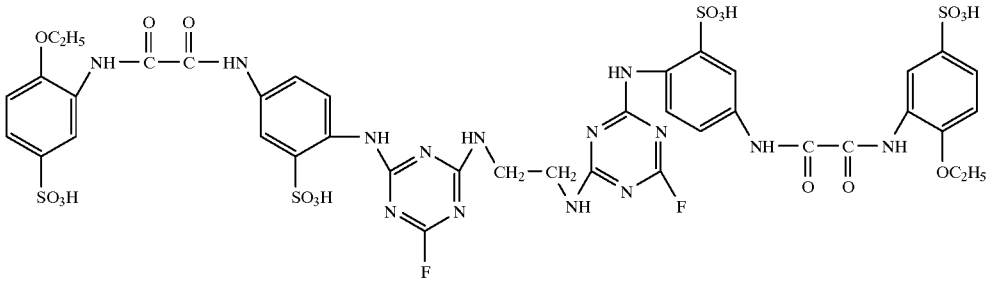
(108)
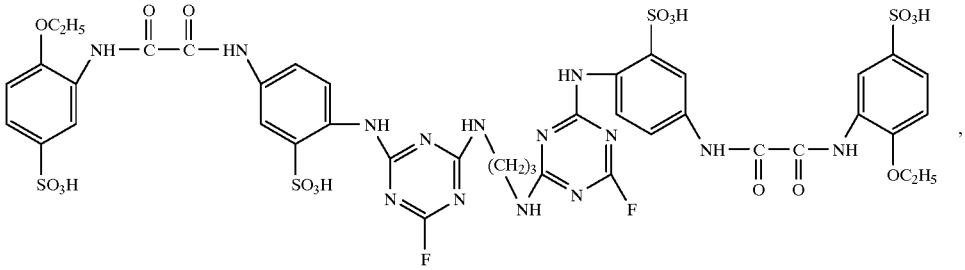

-continued
(109)
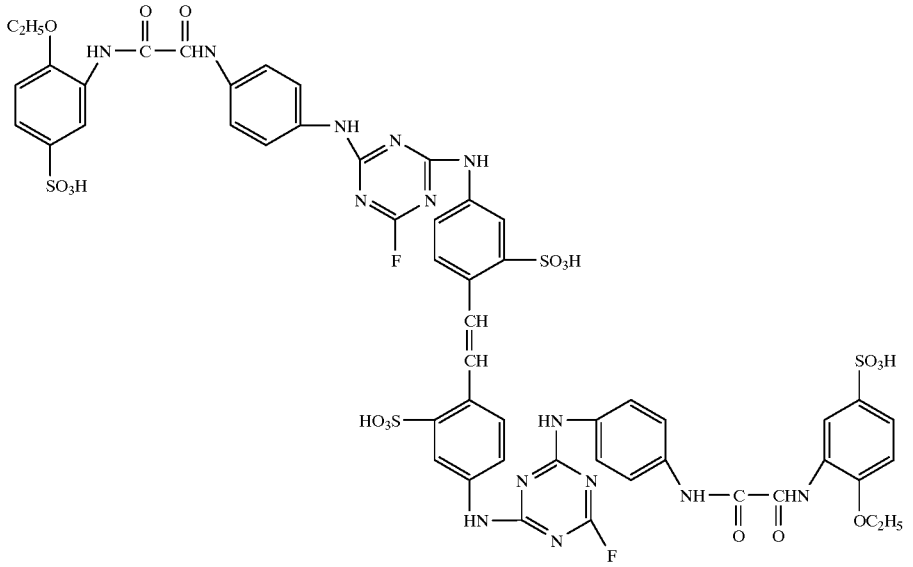
(110)
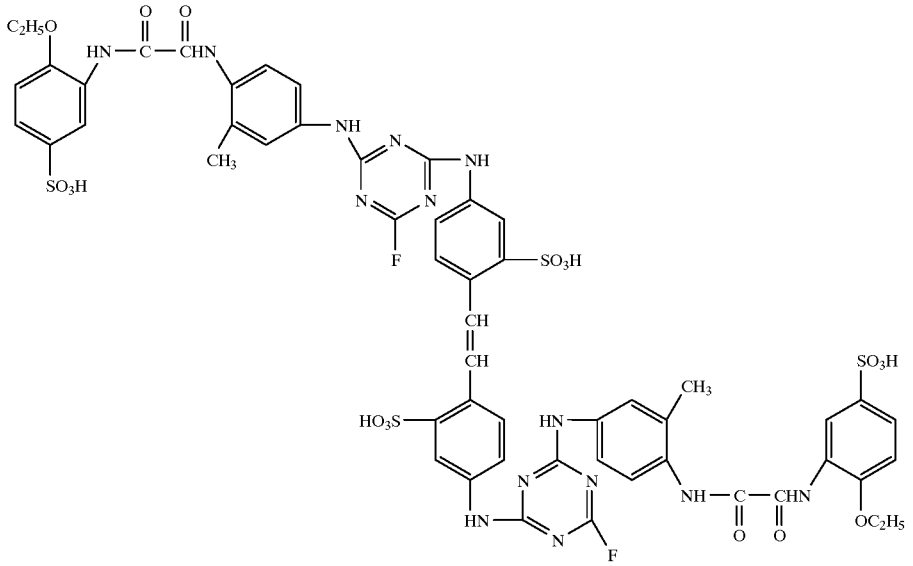
(111)
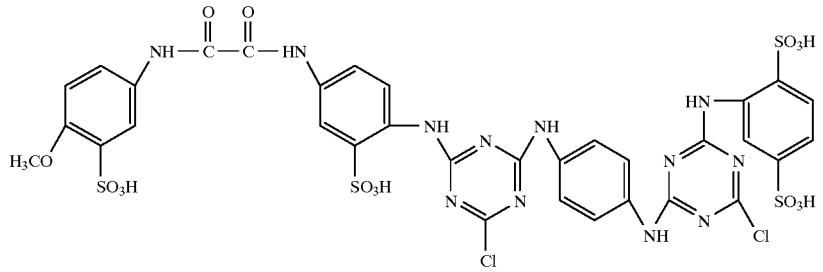
(112)
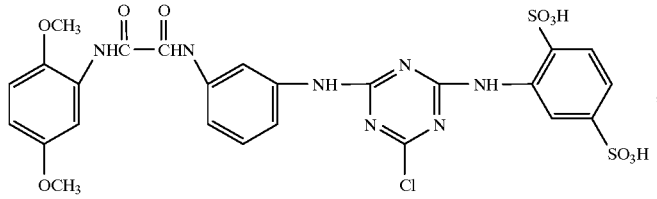

-continued
(113)
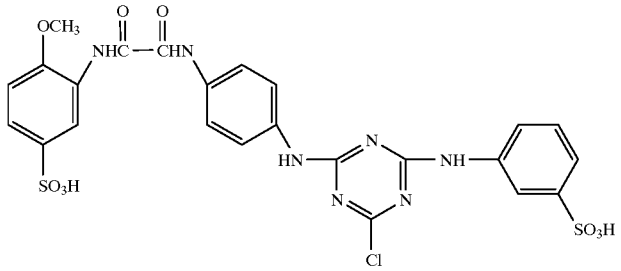
(114)
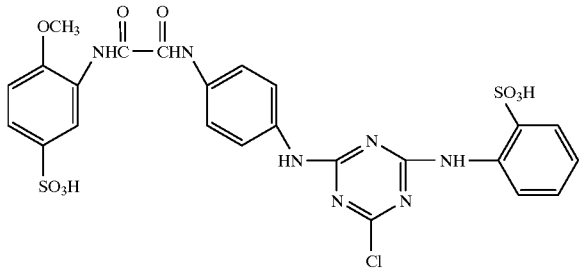
(115)
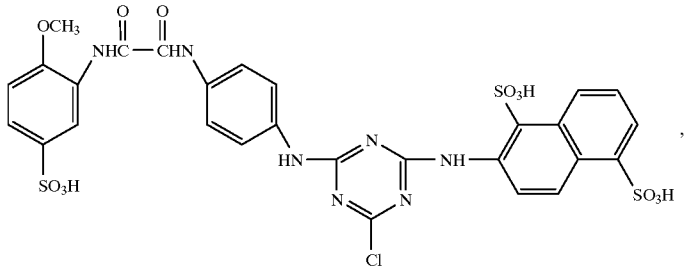
(116)
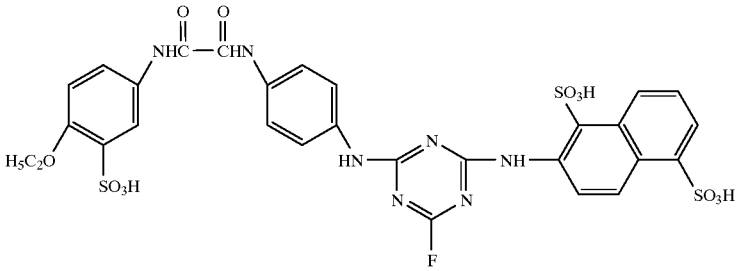
(117)
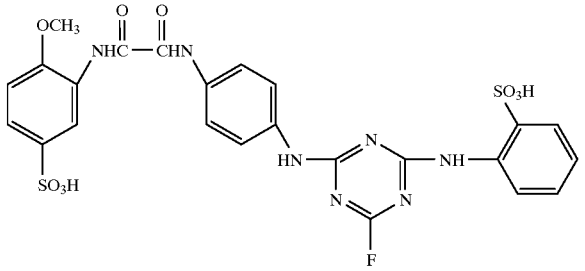

-continued
(118)
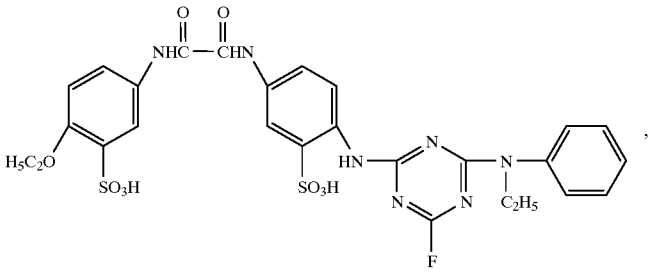
(119)
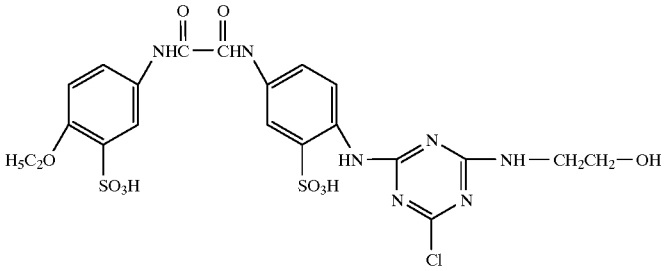
(120)
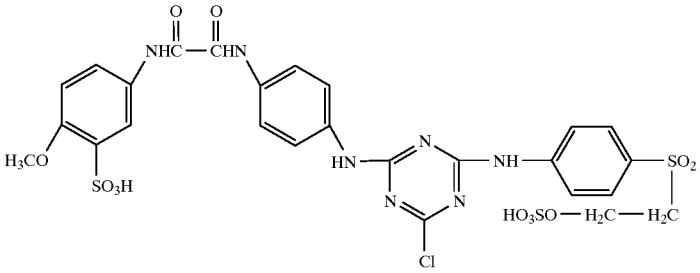
(121)
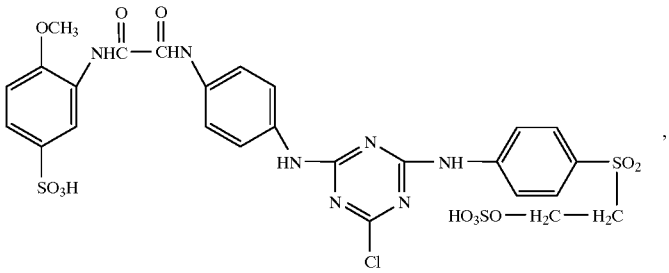
(122)
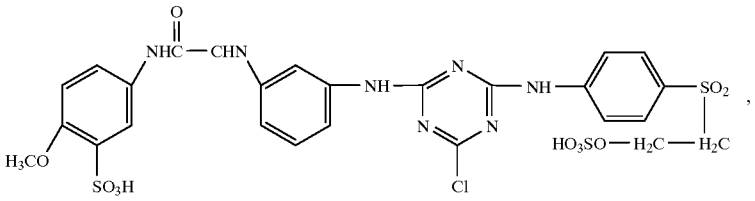

-continued
(123)
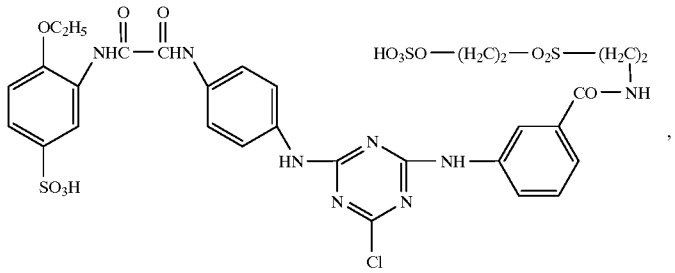
(124)
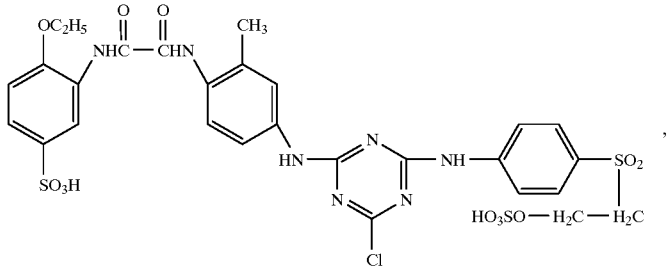
(125)
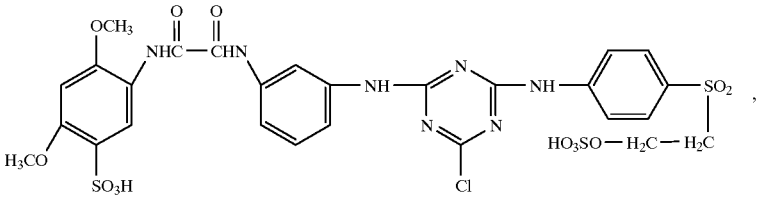
(126)
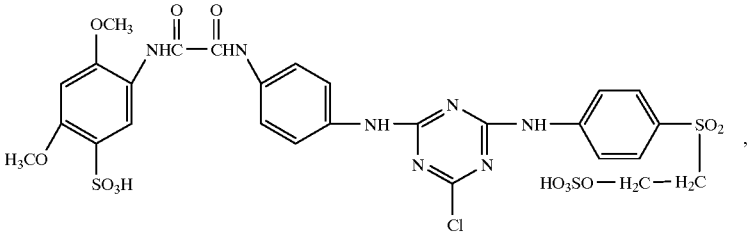
(127)
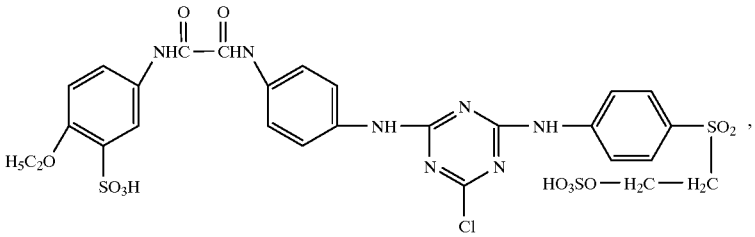
(128)
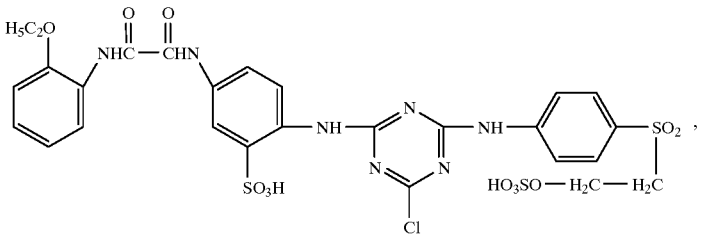

-continued
(129)
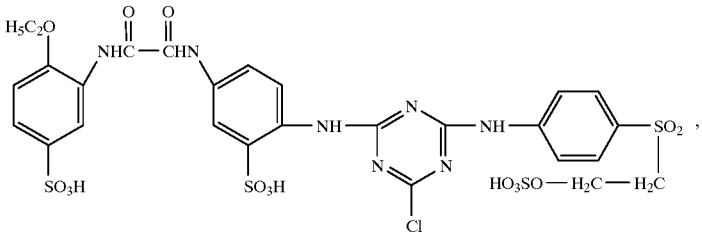
(130)
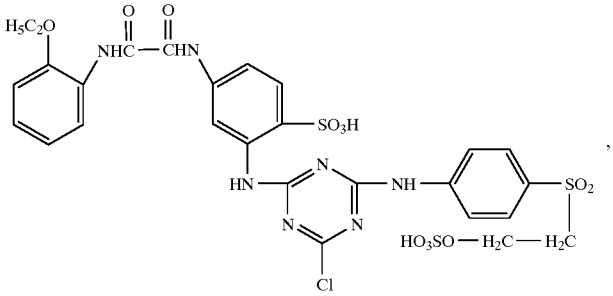
(131)
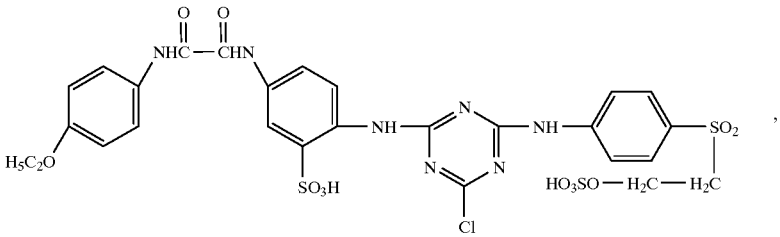
(132)
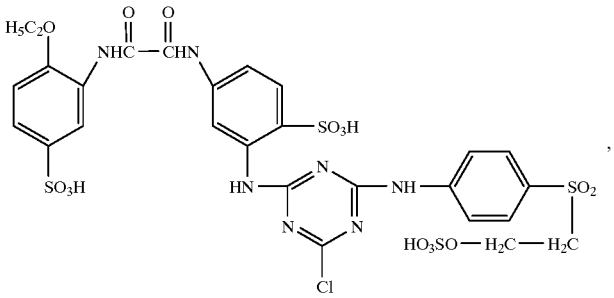
(133)
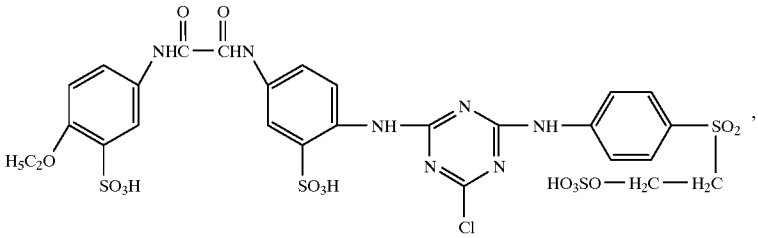

-continued (134)

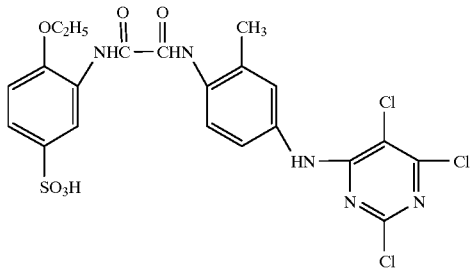

(135)

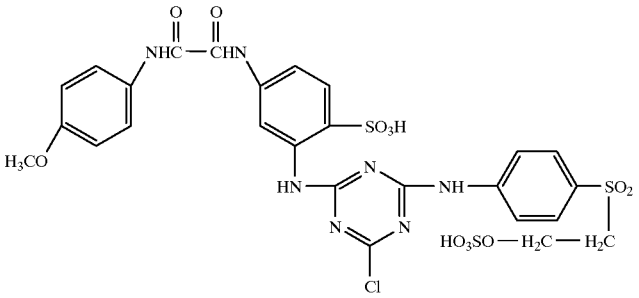

(136)

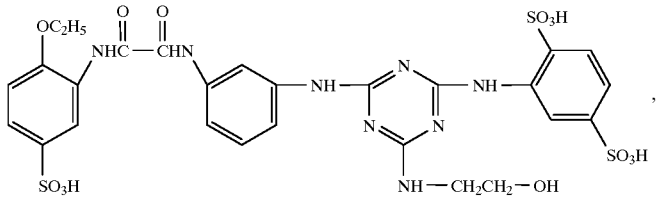

(137)

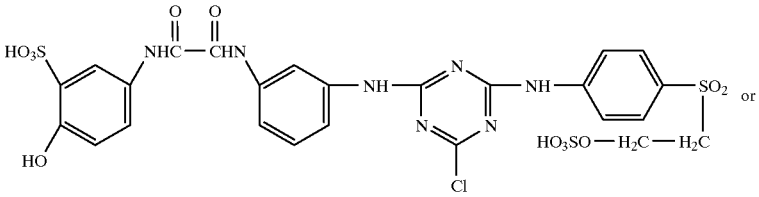

(138)

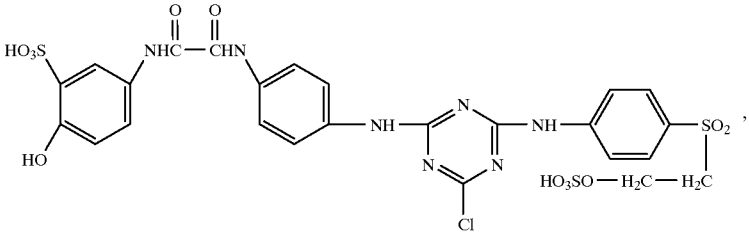

likewise affording dyeings having very good sun protection factors.

What is claimed is:

1. A process for increasing the sun protection factor of undyed cellulosic fibre materials to a value of at least 30, which comprises treating the cellulosic fibre material with 0.001 to 0.2% by weight, based on the weight of the fibre material of at least one reactive dye, and with 0.5% to 1% by weight, based on the weight of the fibre material of at least one reactive UV absorber, or treating the cellulosic fibre material with 0.2 to 2% by weight, based on the weight of the fibre material of at least one reactive dye and 0.05 to 0.5% by weight, based on the weight of fibre material of at least one reactive UV absorber or treating the cellulosic fibre material with 2 to 10% by weight, based on the weight of fibre material of at least one reactive dye and 0.001 to 0.05% by weight, based on the weight of the fibre material of at least one reactive UV absorber.

2. A process according to claim 1, wherein the amount of reactive dye used is from 0.001 to 0.2% by weight, based on the weight of the fibre material, and the amount of reactive UV absorber used is from 0.5 to 1% by weight, based on the weight of the fibre material.

3. A process according to claim 1, wherein the amount of reactive dye used is from 0.2 to 2% by weight, based on the weight of the fibre material, and the amount of reactive UV absorber used is from 0.05 to 0.5% by weight, based on the weight of the fibre material.

4. A process according to claim 1, wherein the reactive UV absorber is used together with the reactive dye.

5. A process according to claim 1, wherein the reactive dye used is a monoazo, polyazo, metal complex azo, anthraquinone, phthalocyanine, formazan, azomethine, dioxazine, phenazine, stilbene, triphenylmethane, xanthene, thioxanthone, nitroaryl, naplhthoquinone, pyrenequinone or perylenetetracarbimide class reactive dye.

6. A process according to claim 5, wherein the reactive dye used is a monoazo, disazo, metal complex azo, formazan, anthraquinone, phthalocyanine or dioxazine class reactive dye.

7. A process according to claim 1, wherein the reactive group of the reactive dye used is a 1,3,5-triazine radical of the formula (1)

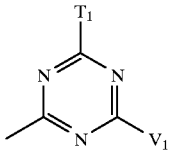

where $T_1$ is fluorine, chlorine or carboxypyridinium and $V_1$ is fluorine, chlorine, —$NH_2$, $C_1$–$C_6$alkylamino, N,N-di-$C_1$–$C_6$alkylamino, cyclohexylamino, N,N-dicyclohexylamino, benzylamino, phenethylamino, phenylamino, naphthylamino, N—$C_1$–$C_6$alkyl-N-cyclohexylamino, N—$C_1$–$C_6$alkyl-N-phenylamino, morpholino, piperidino, piperazino, hydrazino, semicarbazido, or furanyl-, thiophenyl-, pyrazolyl-, pyridyl-, pyrimidyl-, quinolinyl-, benzimidazolyl-, benzothiazolyl- or benzoxazolyl-substituted amino.

8. A process according to claim 1, wherein the reactive group of the reactive dye used is a radical of the formula (2)

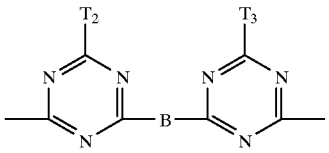

where $T_2$ and $T_3$ are independently of each other fluorine, chlorine or carboxypyridinium and B is a bridge member.

9. A process according to claim 1, wherein the reactive group of the reactive dye used is a radical of the formula (3)

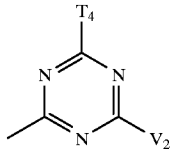

where $T_4$ is fluorine, chlorine or carboxypyridinium and $V_2$ is a radical of the formula (4)

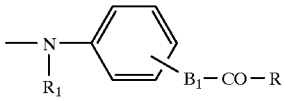

where $R_1$ is hydrogen or $C_1$–$C_4$alkyl which may be substituted by halogen, hydroxyl, cyano, $C_1$–$C_4$alkoxy, $C_1$–$C_4$alkoxycarbonyl, carboxyl, sulfamoyl, sulfo or sulfato; $B_1$ is a direct bond or a radical $-(CH_2)_n-$ or $—O-(CH_2)_n-$; n= 1, 2, 3, 4, 5 or 6; and R is a radical of the formula (4a)

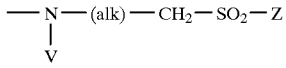

(4b)

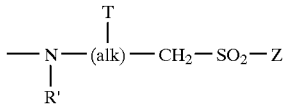

(4c)

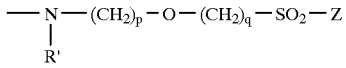

(4d)

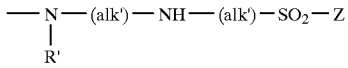

(4e)

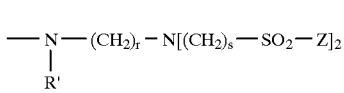

(4f)

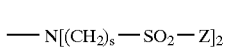

or (4g)

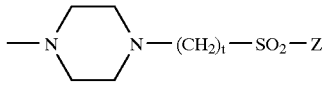

where R' is hydrogen or $C_1$–$C_6$alkyl, alk is an alkylene radical having 1 to 7 carbon atoms, T is hydrogen, halogen, hydroxyl, sulfato, carboxyl, cyano, $C_1$–$C_4$alkanoyloxy, $C_1$–$C_4$alkoxycarbonyl, carbamoyl or a radical —$SO_2$—Z, V is hydrogen, substituted or unsubstituted $C_1$–$C_4$alkyl or a radical of the formula (4h)

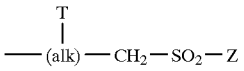

where (alk) is as defined above, each alk' is independently of the other polymethylene having 2 to 6 carbon atoms, Z is β-sulfatoethyl, β-thiosulfatoethyl, β-phosphatoethyl, β-acyloxyethyl, β-haloethyl or vinyl, p, q, r and t are each independently of the others 1, 2, 3, 4, 5 or 6 and s is 2, 3, 4, 5 or 6; and the benzene ring in the formula (4) may contain further substituents; or where $V_2$ is a radical of the formula (4a), (4b), (4c), (4d), (4e), (4f) or (4g) which is directly bonded to the triazine ring and in which R', T, alk, V, alk', Z, p, q, r, s and t are each as defined above; or where $V_2$ is a radical of the formula (4')

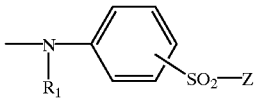

where $R_1$ and Z are each as defined above and the benzene ring may be further substituted.

10. A process according to claim 1, wherein the reactive group of the reactive dye used is a radical of the formula (4i)

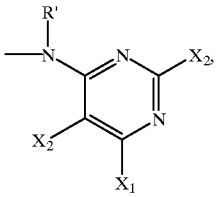

(4j)

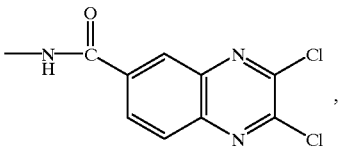

(4k)

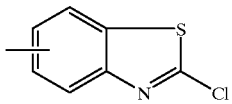

or (4l)

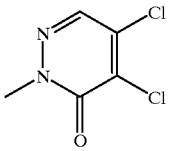

where R' is hydrogen or $C_1$–$C_6$alkyl and $X_1$ and $X_2$ are each chlorine, or $X_1$ is chlorine and $X_2$ is fluorine.

11. A process according to claim 1, wherein the reactive group of the reactive dye used is a radical of the formula $$—SO_2Z \quad (5a),$$

$$—SO_2—NH—Z \quad (5b),$$

$$—NH—CO—(CH_2)_3—SO_2Z \quad (5c),$$

$$—CO—NH—CH_2CH_2—SO_2Z \quad (5d)$$

or $$—NH—CO—Z_1 \quad (5e)$$

where Z is β-sulfatoethyl, β-thiosulfatoethyl, β-phosphatoethyl, β-acyloxyethyl, β-haloethyl or vinyl and $Z_1$ has the meaning of Z and may additionally be halomethyl or α,β-dihaloethyl.

12. A process according to claim 1, wherein the reactive UV absorber used is a compound of the formula (26)

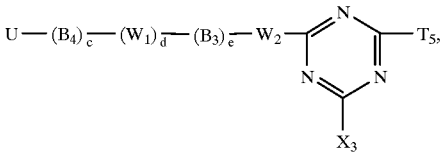

where $B_3$ and $B_4$ are each independently of the other an aliphatic bridge member, U is the radical of a UV absorber selected from the group consisting of the 2-hydroxybenzophenones, benzotriazoles, 2-hydroxyphenyl-1,3,5-triazines, oxalamides, acrylates, substituted and unsubstituted benzoic acids and esters and radicals of the formula (27)

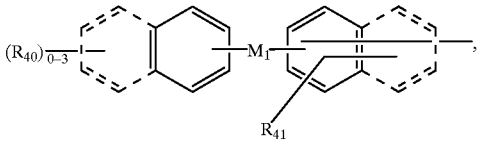

$(R_{40})_{0-3}$ denotes from 0 to 3 identical or different radicals $R_{40}$ selected from the group consisting of sulfo, $C_1$–$C_4$alkyl, $C_1$–$C_4$alkoxy, halogen, hydroxyl, carboxyl, nitro and $C_1$–$C_4$alkylcarbonylamino, $R_{41}$ is hydrogen, sulfo, $C_1$–$C_4$alkyl or $C_1$–$C_4$alkoxy, $M_1$ is a group —NR"—CO— or —NR"—$SO_2$—, R" is hydrogen or $C_1$–$C_4$alkyl, $W_2$ is a group —$NR_{42}$—, —O— or —S—, $R_{42}$ is hydrogen or substituted or unsubstituted $C_1$–$C_4$alkyl, $W_1$ is a radical —C(O)O—, —O(O)C—, —C(O)NH— or —HN(O)C—, $X_3$ is halogen, hydroxyl, sulfo, $C_1$–$C_4$alkylsulfonyl, phenylsulfonyl, substituted or unsubstituted amino, 3-carboxypyridin-1-yl or 3-carbamoylpyridin-1-yl, $T_5$ independently has one of the meanings indicated for $X_3$ or is an optionally further substituted alkoxy, aryloxy, alkylthio or arylthio radical or is a nitrogen-containing heterocyclic radical or is a reactive radical of the formula (28a)

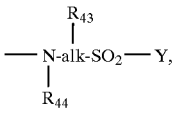

(28b)

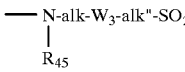

(28c)

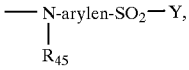

(28d)

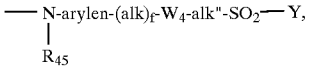

(28e)

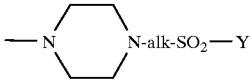

or (28f)

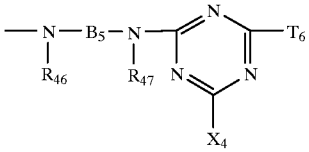

where $B_5$ is an aliphatic, cycloaliphatic, aromatic or aromatic-aliphatic bridge member or together with —$NR_{46}$— and —$NR_{47}$— is a heterocyclic ring, $R_{46}$ and $R_{47}$ are each independently of the other hydrogen or substituted or unsubstituted $C_1$–$C_4$alkyl, $X_4$ is halogen, hydroxyl, substituted or unsubstituted amino, 3-carboxypyridin-1-yl or 3-carbamoylpyridin-1-yl, $T_6$ independently has one of the meanings indicated for $X_4$ or is an optionally further substituted alkoxy, aryloxy, alkylthio or arylthio radical or is a nitrogen-containing heterocyclic radical or independently a radical U—$(B_4)_c$—$(W_1)_d$—$(B_3)_e$—$W_2$—, where U, $B_4$, $B_3$, $W_1$ and $W_2$ are each as defined above, $R_{44}$ is hydrogen, unsubstituted or hydroxyl-, sulfo-, sulfato-, carboxyl- or cyano-substituted $C_1$–$C_4$alkyl or a radical

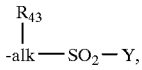

$R_{45}$ is hydrogen or $C_1$–$C_4$alkyl, $R_{43}$ is hydrogen, hydroxyl, sulfo, sulfato, carboxyl, cyano, halogen, $C_1$–$C_4$alkoxycarbonyl, $C_1$–$C_4$alkanoyloxy, carbamoyl or the group —$SO_2$—Y, alk and alk" are independently of each other $C_1$–$C_7$alkylene, arylen is an unsubstituted or sulfo-, carboxyl-, $C_1$–$C_4$alkyl-, $C_1$–$C_4$alkoxy- or halogen-substituted phenylene or naphthylene radical, Y is vinyl or a radical —$CH_2$—$CH_2$—$Z_2$ and $Z_2$ is a leaving group, $W_3$ is —O— or —$NR_{45}$—, $W_4$ is a group —$SO_2$—$NR_{44}$—, —$CONR_{44}$— or —$NR_{44}CO$—, and c, d, e and f are each independently of the others 0 or 1 with d being 0 when e is 0, with the proviso that the compounds of the formula (26) have at least one sulfo or sulfato group and at least one alkali-detachable group.

13. A process according to claim 12, wherein the reactive UV absorber used is a compound of the formula (26) where U is a radical of an oxalic diarylamide of the formula (35)

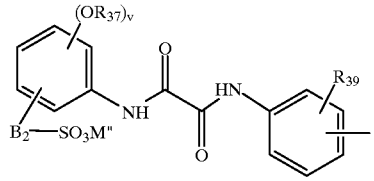

where $R_{37}$ is hydrogen, unsubstituted or hydroxyl- or alkoxy-substituted $C_1$–$C_5$alkyl or unsubstituted or $C_1$–$C_5$alkyl-substituted benzyl;

$R_{39}$ is hydrogen; halogen; $C_1$–$C_{12}$alkyl; phenyl-$C_1$–$C_5$alkyl or $C_1$–$C_5$alkoxy;

$B_2$ is a direct bond or a bivalent radical of the formula—O—$L_1$—, where $L_1$ is unsubstituted or hydroxyl-substituted $C_1$–$C_6$alkylene;

M" is hydrogen or an alkali metal and v is 2; 1 or 0.

14. A process according to claim 1, wherein the cellulosic fibre materials used have a density between 30 and 200 g/$m^2$.

15. A process according to claim 1, wherein the cellulosic fibre material used is cotton.

* * * * *